US008672433B2

(12) United States Patent
Kusakari

(10) Patent No.: US 8,672,433 B2
(45) Date of Patent: Mar. 18, 2014

(54) LIQUID EJECTION HEAD AND LIQUID EJECTION APPARATUS

(75) Inventor: Tsutomu Kusakari, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/598,694

(22) Filed: Aug. 30, 2012

(65) Prior Publication Data

US 2013/0050315 A1 Feb. 28, 2013

(30) Foreign Application Priority Data

Aug. 31, 2011 (JP) ..... 2011-189671

(51) Int. Cl.
*B41J 29/38* (2006.01)

(52) U.S. Cl.
USPC ..... 347/9; 347/12; 347/13; 347/40; 347/42

(58) Field of Classification Search
USPC ..... 347/12, 13, 9, 20, 40, 42, 49
See application file for complete search history.

(56) References Cited

U.S. PATENT DOCUMENTS

| | | | | |
|---|---|---|---|---|
| 6,123,410 | A | 9/2000 | Beerling et al. | |
| 7,540,578 | B2 * | 6/2009 | Suzuki et al. | 347/12 |
| 2002/0114652 | A1 | 8/2002 | Morozumi et al. | |
| 2010/0156980 | A1 | 6/2010 | Azuma et al. | |
| 2010/0289852 | A1 | 11/2010 | Woolfe et al. | |

FOREIGN PATENT DOCUMENTS

| | | | |
|---|---|---|---|
| JP | 2002-86695 | A | 3/2002 |
| JP | 2002-210942 | A | 7/2002 |
| JP | 2002-225255 | A | 8/2002 |
| JP | 2006-218753 | A | 8/2006 |
| JP | 2007-261021 | A | 10/2007 |
| JP | 2008-185365 | A | 8/2008 |
| JP | 2009-66566 | A | 4/2009 |
| JP | 2010-143138 | A | 7/2010 |
| JP | 2010-524739 | A | 7/2010 |

OTHER PUBLICATIONS

Japanese Office Action dated Oct. 15, 2013 for Japanese Application No. 2011-189671 with partial English translation is provided.

* cited by examiner

*Primary Examiner* — Juanita D Jackson
(74) *Attorney, Agent, or Firm* — Birch, Stewart, Kolasch & Birch, LLP

(57) ABSTRACT

According to the liquid ejection head and the liquid ejection apparatus of the present invention, it is possible to reduce wasted nozzles in a joint section by reducing the total number of nozzles $N_A$ included in a joint section between head units that are positioned and fixed with high accuracy, while diminishing discontinuity of liquid ejection in joint sections between head units and joint sections between intermediate units, and furthermore, it is possible to make the replacement of each intermediate unit easy and hence to reduce the work involved in replacing intermediate units by further increasing the total number of nozzles $N_B$ included in joint sections between intermediate units which are fixed with less strict positioning accuracy than the head units.

13 Claims, 17 Drawing Sheets

LIQUID EJECTION HEAD AND LIQUID EJECTION APPARATUS

BACKGROUND OF THE INVENTION

1. Field of the Invention

The present invention relates to a liquid ejection head and a liquid ejection apparatus, and more particularly to a structure of a liquid ejection head which is composed by joining together a plurality of head units.

2. Description of the Related Art

An inkjet head which is applied in an inkjet recording apparatus may adopt a mode in which a plurality of head units (head modules) are joined together. An inkjet head of this kind can print onto a wider printing region in one operation. Furthermore, in cases where the inkjet head does not pass manufacturing inspection, or where the inkjet head is replaced due to the occurrence of a fault or the end of the lifespan, then a further merit is obtained in that the head units can be replaced individually.

On the other hand, accurate positioning is required when joining together the head units. If variation occurs in the positions of the respective head units, then density non-uniformities (banding) occur in the joint sections between the head units.

In order to diminish density non-uniformities caused by discontinuity in the nozzle arrangement in the joint sections between head units of this kind, the head units (nozzles) are overlapped in the joint sections, so that the nozzle density in the joint sections is higher than the portions other than the joint sections, and the nozzles arranged at high density are selected appropriately to eject droplets, thereby diminishing the density non-uniformities in the image.

Japanese Patent Application Publication No. 2002-225255 discloses an inkjet recording apparatus including a head unit based on a mode in which a plurality of inkjet heads are joined together. The head units (nozzle row groups) are arranged in a staggered matrix fashion so as to be partially overlapping, and the production yield of the head units is increased by appropriately replacing defective inkjet heads.

Japanese Patent Application Publication No. 2007-261021 discloses an inkjet head unit in which a plurality of inkjet heads are arranged. The plurality of inkjet heads are arranged so as to be mutually overlapping in the lengthwise direction and in such a manner that the regions of the nozzles in the end portions of each inkjet head are not proximate to each other in the lengthwise direction.

Japanese Patent Application Publication No. 2009-66566 discloses a method of assembling a liquid ejection head in which a functional liquid ejection head is positioned at a prescribed position on a carriage, an adhesive is caused to flow in between the functional liquid ejection head and the carriage, and the functional liquid ejection head is maintained in a positioned state on the carriage, until the adhesive is solidified.

Japanese Patent Application Publication No. 2008-185365 discloses a head unit in which twelve inkjet heads are mounted on a sub carriage. The inkjet head is screw fastened to a head holding member and the head holding member is welded to a main body plate.

However, if the nozzle density is high in the joint sections between the head units, then this means that a nozzle in only one of one head unit or another head unit is used in order to form one dot. In this case, unused nozzles (redundant nozzles) arise in the joint sections.

Although it is possible to reduce the redundant nozzles by raising the positioning accuracy of the head units, it is difficult to raise the positioning accuracy of the head units when the installation (replacement) of the respective head units is taken into account.

Japanese Patent Application Publication Nos. 2002-225255, 2007-261021, 2009-66566 and 2008-185365 do not make any disclosure with respect to redundant nozzles in the joint sections between head units (inkjet heads). In other words, Japanese Patent Application Publication Nos. 2002-225255, 2007-261021, 2009-66566 and 2008-185365 do not refer to the technical problem of the present invention, or the method of solving this problem, namely, to reduce redundant nozzles in joint sections while making the positioning accuracy required between head units less strict.

SUMMARY OF THE INVENTION

The present invention was devised in view of these circumstances, an object thereof to provide a liquid ejection head and a liquid ejection apparatus which reduces redundant nozzles in joint sections between head units, while making the positioning accuracy required between head units less strict.

In order to achieve the aforementioned object, the liquid ejection head relating to the present invention includes: a head unit provided with a plurality of nozzles which eject liquid; and an intermediate unit provided with a fixing section to which a plurality of the head units are fixed, wherein the intermediate unit is installed in such a manner that intermediate units can be replaced independently, the intermediate unit has a structure in which portions of the nozzles of two head units that are mutually adjacent in a second direction perpendicular to a first direction are mutually overlapped in the first direction, and positions of two head units that are mutually adjacent in the second direction are not overlapped in the second direction; and in a joint section where portions of nozzles of head units that are mutually adjacent in the second direction are overlapping, a relationship between a total number of nozzles $N_A$ included in a joint section between the head units belonging to a same intermediate unit and a total number of nozzles $N_B$ included in a joint section between the intermediate units satisfies: $N_A<N_B$.

According to the present invention, it is possible to reduce wasted nozzles in a joint section by reducing the total number of nozzles $N_A$ included in a joint section between head units that are positioned and fixed with high accuracy, while diminishing discontinuity of liquid ejection in joint sections between head units and joint sections between intermediate units, and furthermore, it is possible to make the replacement of each intermediate unit easy and hence to reduce the work involved in replacing intermediate units by further increasing the total number of nozzles $N_B$ included in joint sections between intermediate units which are fixed with less strict positioning accuracy than the head units.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

[General Composition of Inkjet Head]

Figure 1:
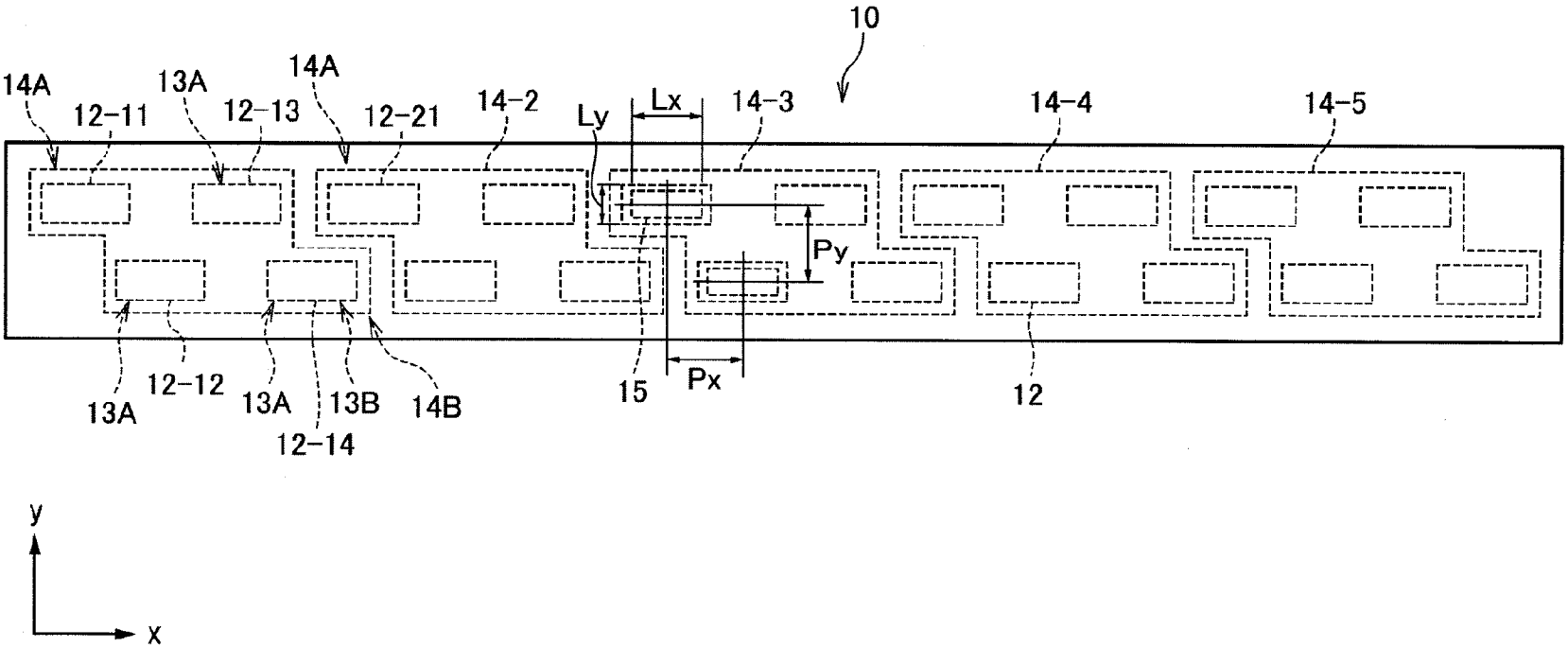
FIG. 1 is a plan view perspective diagram showing a general composition of an inkjet head relating to an embodiment of the present invention.
Figure 11A:
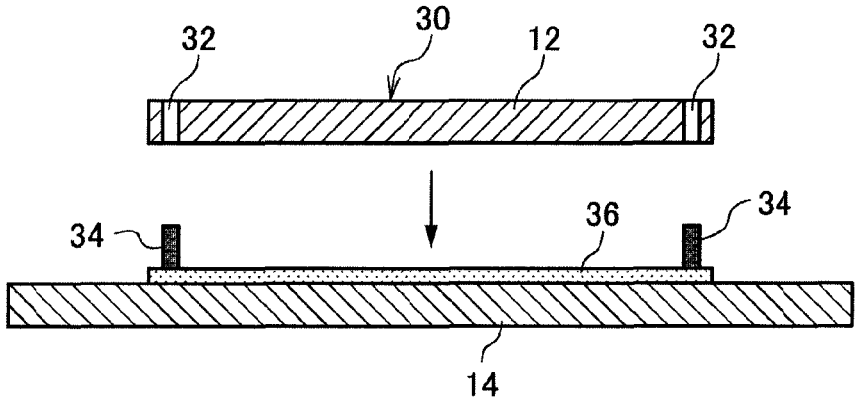
FIGS. 11A and 11B are illustrative diagrams showing a schematic view of a method of fixing a head unit.
Figure 11B:
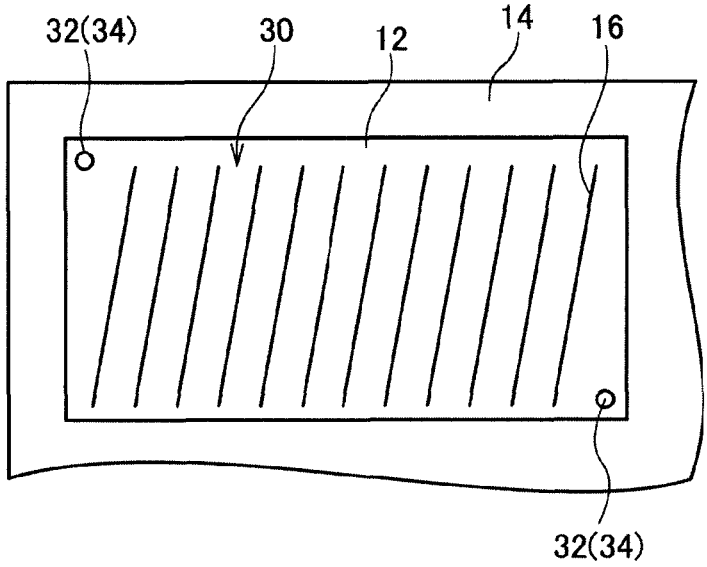

FIG. 1 is a planar perspective diagram showing the general composition of an inkjet head (liquid ejection head) 10 relating to an embodiment of the present invention, and depicts a view from the surface opposite to the surface where the nozzles (not shown in FIG. 1, indicated by reference numeral 20 in FIG. 3) are formed (the nozzle surface, indicated by reference numeral 30 in FIGS. 11A and 11B).

The inkjet head 10 shown in FIG. 1 is a full line type of head in which a plurality of nozzles are arranged through a length corresponding to the entire width of a region where liquid is to be deposited, on a medium onto which sprayed liquid is to be deposited (the entire length in the direction perpendicular to the direction of movement of the medium).

The inkjet head 10 is constituted by head units 12 which are a smallest compositional unit, and intermediate units 14 which are provided with a plurality of head units 12. A lengthwise direction (first direction) x of the inkjet head 10 corresponds to a breadthways direction of the medium (a direction perpendicular to the movement direction of the medium).

The head units 12 provided in the inkjet head 10 are mainly composed from a single material in the planar direction. For example, a nozzle plate in which nozzles are formed is composed from a single plate, and a plate in which flow channels connecting to the nozzles are formed is composed of a single plate in the planar direction. Furthermore, in the inkjet head 10, a plurality of head units 12 are arranged in a two-row staggered configuration in the lengthwise direction x.

The intermediate units 14 are composed by joining together a plurality of head units 12 and a plurality of materials. An example of the plurality of materials is a mode which combines two or more materials from amongst: ceramic, silicon (Si), glass, polyimide, liquid crystal polymer (LCP), acryl nitrile-butadiene-styrene (ABS), polyacetal (POM, polycarbonate (PC)), epoxy, or various other resins, or metals such as stainless steel, nickel, aluminum, aluminum alloy, copper, steel, or the like.

In other words, the intermediate units 14 each respectively include the same number of head units 12 which each have the same composition, and the intermediate units 14 themselves each have the same structure. Furthermore, the intermediate unit 14-1 to intermediate unit 14-5 shown in FIG. 1 are arranged in one row in the lengthwise direction x of the inkjet head 10.

The inkjet head 10 shown in FIG. 1 includes intermediate units 14 (14-1 to 14-5) which are each equipped with four head units 12 arranged in a two-row staggered configuration. The arrangement pitch $P_x$ of the head units 12 in the lengthwise direction x of the inkjet head 10 is less than the length $L_x$ in the same direction of the nozzle arrangement region 15, which is a region where nozzles are provided in each head unit 12.

Furthermore, the arrangement pitch $P_y$ of the head units 12 in the breadthways direction (second direction) y of the inkjet head 10 is greater than the length $L_y$ of the head units 12 in the same direction.

As shown in FIG. 1, each intermediate unit 14 is arranged so as not to interfere with the adjacent intermediate units 14, in the lengthwise direction x of the inkjet head 10.

The intermediate units 14 each have projecting sections 14A, 14B at either end in the lengthwise direction x of the inkjet head 10, the planar shape of the intermediate unit 14 being such that the projecting section 14A at one end (the left-side end in FIG. 1) and the projecting section 14B at the other end (the right-side end in FIG. 1) are located in mutually displaced positions in the breadthways direction y of the inkjet head 10 (which corresponds to the movement direction of the medium).

The intermediate units 14-1 and 14-2 are arranged in such a manner that the projecting section 14A of the intermediate unit 14-2 positioned adjacently to the right of the intermediate unit 14-1 enters into a recess which corresponds to the projecting section 14B of the intermediate unit 14-1 on the left-side end in FIG. 1. The intermediate units 14 from intermediate unit 14-3 to intermediate unit 14-5 are also arranged in a similar fashion.

The head units 12 which are adjacent in the breadthways direction y of the inkjet head 10 are arranged at mutually overlapping positions in the lengthwise direction x of the nozzle arrangement regions 15. A region where the nozzle arrangement regions 15 are overlapping is called a joint section 13. For example, the head unit 12-11 and the head unit 12-12 are mutually adjacent in the breadthways direction y of the inkjet head 10 and the right-side end region of the head unit 12-11 and the left-side end region of the head unit 12-12 are mutually overlapping in the lengthwise direction x of the inkjet head 10.

Similarly, the right-side end region of the head unit 12-12 and the left-side end region of the head unit 12-13, and the right-side end region of the head unit 12-13 and the left-side end region of the head unit 12-14 are also mutually overlapping in the lengthwise direction x of the inkjet head 10. In this way, a portion where the adjacent head units 12 are mutually overlapping in the lengthwise direction x of the inkjet head 10 constitutes a joint section 13A between head units 12.

Furthermore, if head units 12 which are adjacent in the breadthways direction y of the inkjet head 10 belong to different intermediate units 14, then the joint section therebetween is a joint section 13B between intermediate units 14.

For example, the joint section between the head unit 12-14 which belongs to the intermediate unit 14-1 and the head unit 12-21 which belongs to the intermediate unit 14-2 is a joint section 13B between intermediate units 14.

Figure 2:
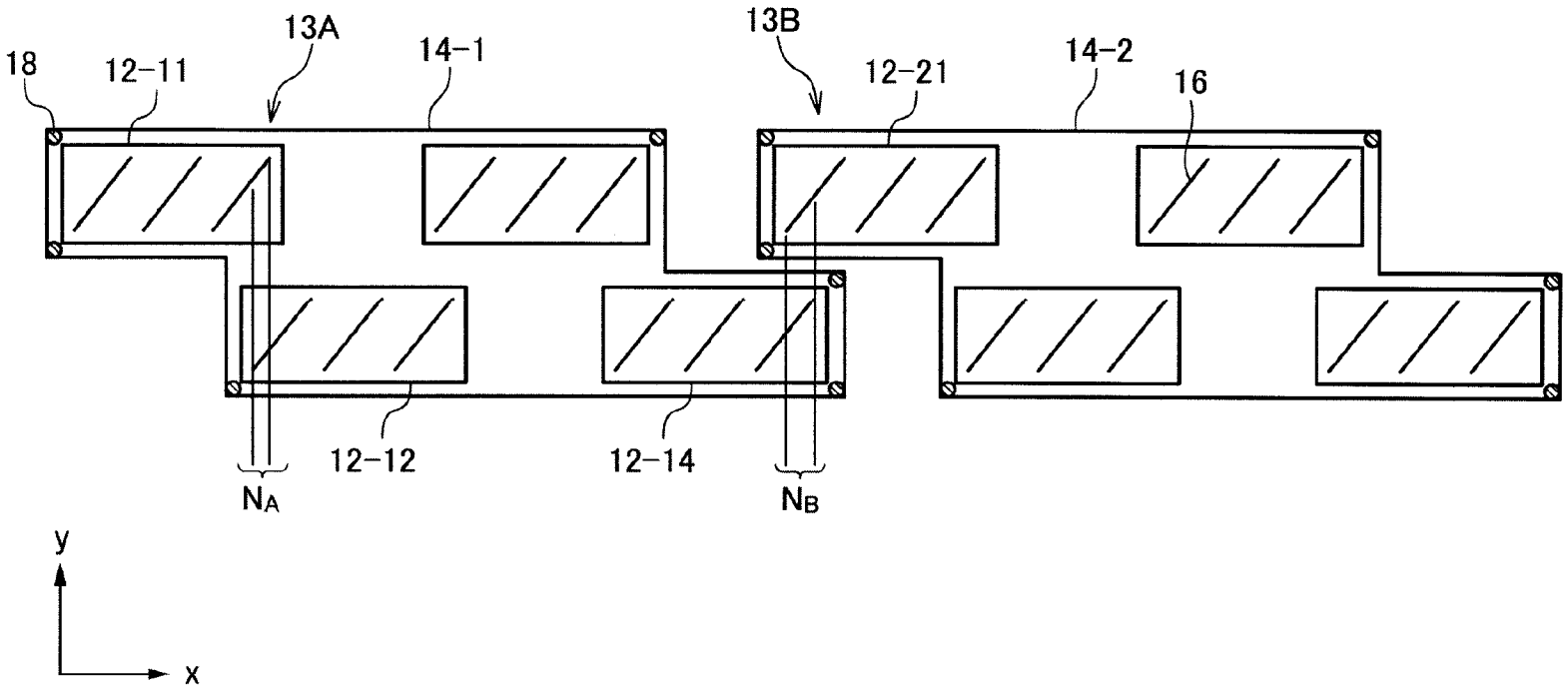
FIG. 2 is a partial enlarged diagram of the inkjet head shown in FIG. 1.

FIG. 2 is an enlarged diagram showing an enlarged view of one portion of the inkjet head 10 shown in FIG. 1 (a portion corresponding to two intermediate units). FIG. 2 is a planar perspective diagram viewed from the opposite side to the nozzle surface, similarly to FIG. 1, and elements which are only visible from the nozzle surface, such as the head units 12, are depicted by solid lines.

Furthermore, the oblique solid lines which are indicated by the reference numeral 16 in FIG. 2 represent the nozzle rows of the head units 12 (only three rows are shown as representative examples of a plurality of nozzle rows). More specifically, the head units 12 shown in FIG. 2 have a structure in which the nozzles are arranged in a matrix configuration.

If the total number of nozzles in a joint section 13A between head units 12 belonging to the same intermediate unit 14 is taken as $N_A$ and if the total number of nozzles in a joint section 13B between intermediate units 14 (a joint section between head units 12 belonging to different intermediate units 14) is taken as $N_B$, then these numbers satisfy the relationship $N_A<N_B$.

The "total number of nozzles in a joint section" is the total number of nozzles included in the joint section of the two head units 12 which constitute the joint section 13. For example, in the joint section between the head unit 12-11 and the head unit 12-12, this is the sum of the number of nozzles of the head unit 12-11 which are included in the joint section 13A and the number of nozzles of the head unit 12-12 which are included in the joint section 13A.

The members indicated by the reference numeral 18 in FIG. 2 are fixing members (for example, screws) for fixing the intermediate units 14 to intermediate unit attachment units (not illustrated) of the inkjet head 10. In the inkjet head 10, the intermediate units 14 are fixed by using mechanical fixing members in such a manner that the intermediate units 14 can be replaced individually (a more detailed description is hereinafter).

On the other hand, although not shown in FIG. 2, the head units 12 are positioned with high accuracy on head unit fixing sections (not illustrated) of the intermediate units 14 (with a positioning error of several micrometers approximately), and are then bonded with adhesive (see FIGS. 11A and 11B). It is also possible to adopt a mode for positioning the head units 12 with high accuracy by forming the head units 12 and the intermediate units 14 in an integrated fashion.

Since a fixing method capable of highly accurate positioning is employed to fix the head units 12, then it is possible to reduce yet further the number of nozzles for diminishing discontinuity of ejection in the joint sections between the head units 12.

On the other hand, since the mode of fixing the intermediate units 14 gives priority to easy installation and removal, then it is difficult to achieve positioning of the same high accuracy as the fixing of the head units 12. Therefore, discontinuity of ejection in the joint sections 13B between the respective intermediate units 14 is diminished by increasing the number of nozzles in the joint sections.

Consequently, since the heads are composed in such a manner that the total number of nozzles $N_A$ included in the joint sections 13A between the head units 12 and the total number of nozzles $N_B$ included in the joint sections 13B between the intermediate units 14 satisfy the relationship described above, then the number of redundant nozzles in the joint sections 13 (13A) can be reduced, while at the same time diminishing discontinuity of ejection in the joint sections 13A between the head units 12 and the joint sections 13B between the intermediate units 14.

The details of the total number of nozzles $N_A$ included in the joint sections 13A between the head units 12 and the total number of nozzles $N_B$ included in the joint sections 13B between the intermediate units 14 are described below.

[Description of Head Unit]

Figure 3:
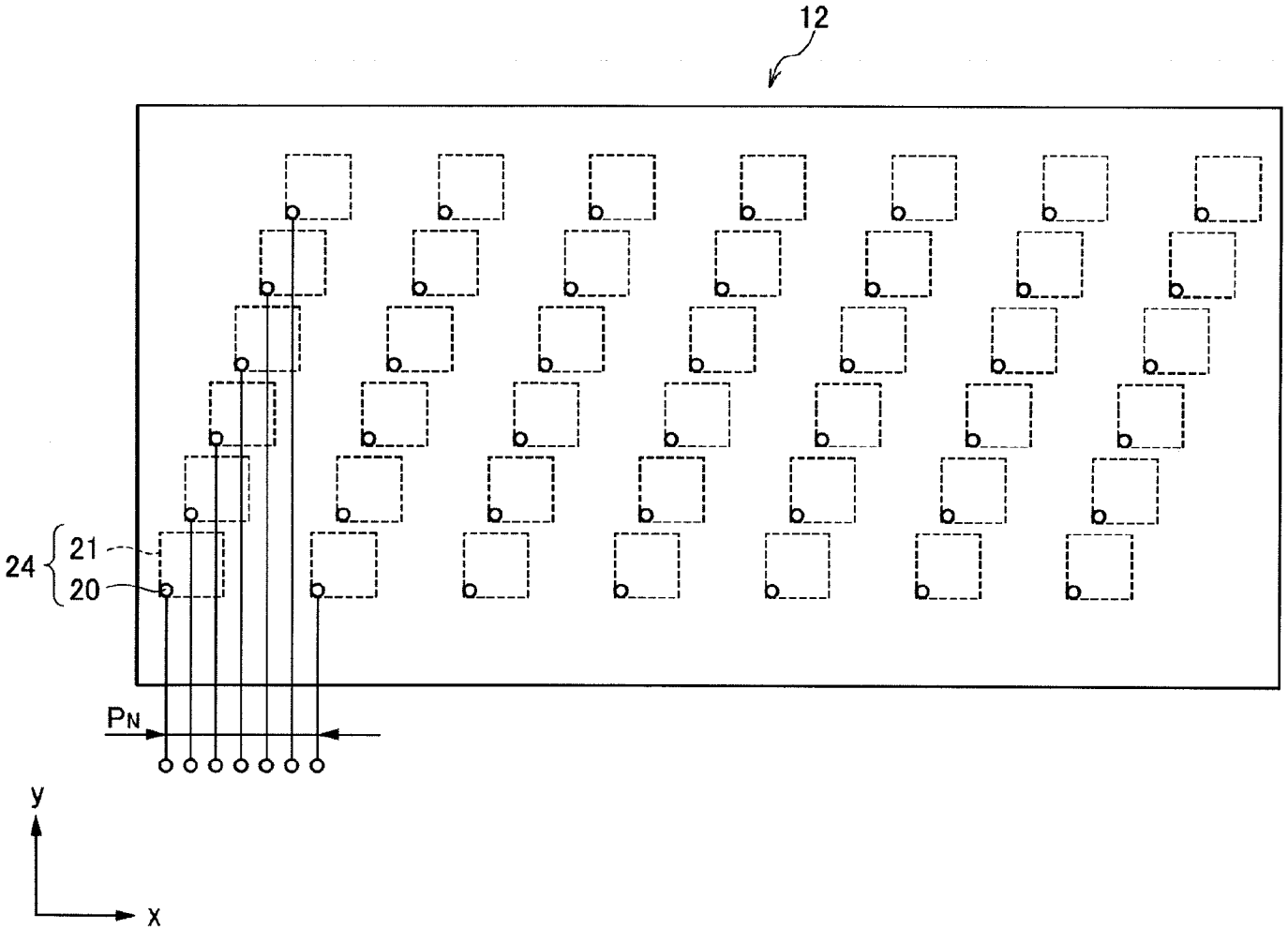
FIG. 3 is a plan view perspective diagram showing an approximate structure of the head unit shown in FIG. 1.

FIG. 3 is a plan view perspective diagram showing an approximate structure of a head unit 12. As shown in FIG. 3, in the head unit 12, ejection elements 24 including nozzles 20 and pressure chambers 21 which connect to the nozzles 20 are arranged in a matrix configuration, so that overall a nozzle arrangement density capable of achieving a predetermined ejection resolution is obtained.

In other words, the nozzles 20 (pressure chambers 21) which are included in the head unit 12 are arranged in a row direction following a lengthwise direction x of the inkjet head 10, and a column direction forming a prescribed angle with the lengthwise direction x (or breadthways direction y) of the inkjet head 10, and the effective nozzle pitch in the lengthwise direction x of the inkjet head 10 is $P_N$.

FIG. 3 shows an example of a six-row seven-column matrix arrangement, but the number of nozzles per column and the number of nozzle columns are not limited to this example.

Figure 4A:
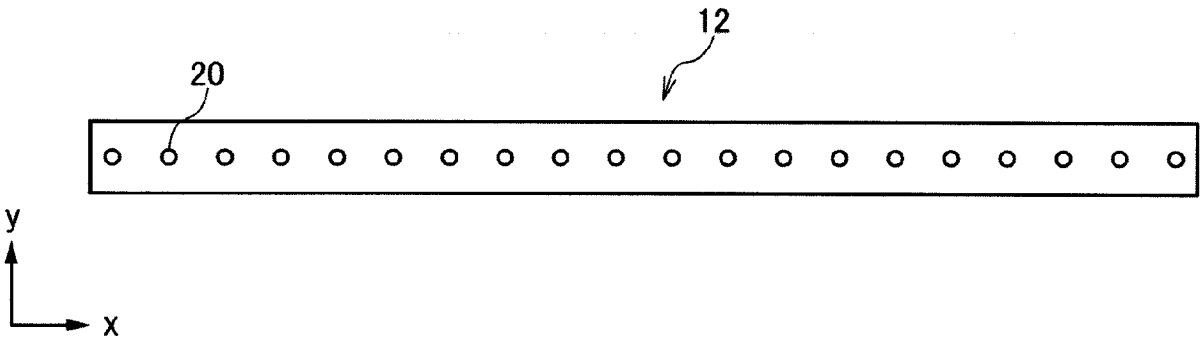
FIGS. 4A and 4B are schematic plan diagrams showing a further example of a nozzle arrangement in a head unit.
Figure 4B:
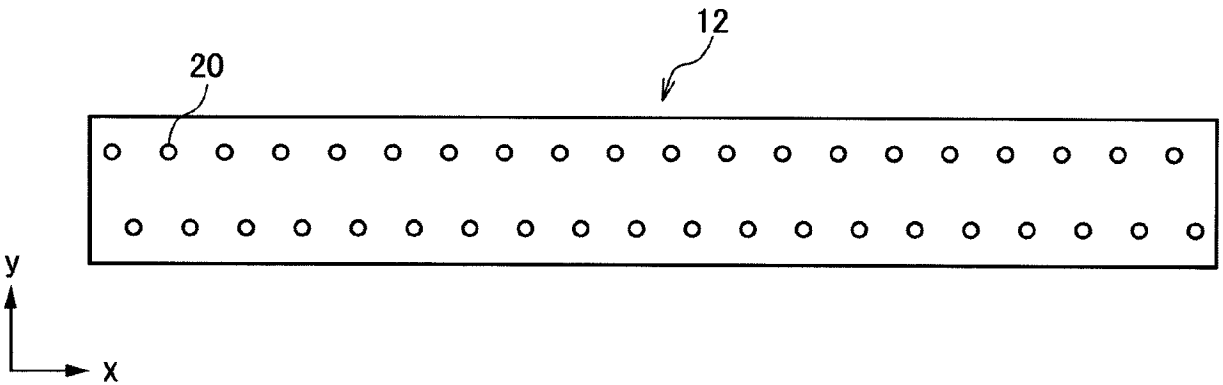

Furthermore, the nozzle arrangement in the head units 12 is not limited to the matrix configuration shown in FIG. 3. For example, it is also possible to adopt a mode in which nozzles are arranged in one row in the lengthwise direction x of the inkjet head 10, as shown in FIG. 4A, or a mode where the nozzles are arranged in a two-row staggered matrix configuration in the lengthwise direction x of the inkjet head 10, as shown in FIG. 4B.

[Description of Joint Sections]

(Structure of Joint Sections)

Figure 5A:
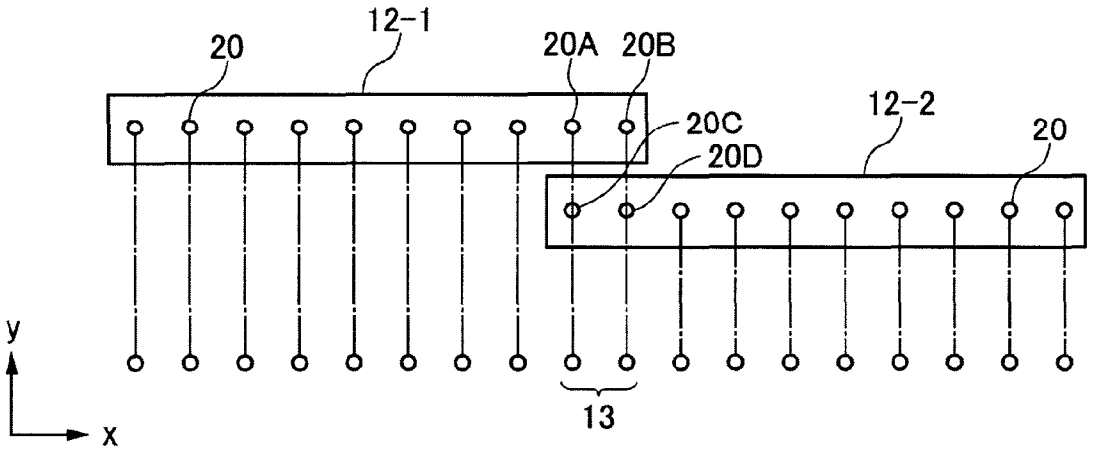
FIGS. 5A and 5B are diagrams illustrating a nozzle arrangement in a joint section.
Figure 5B:
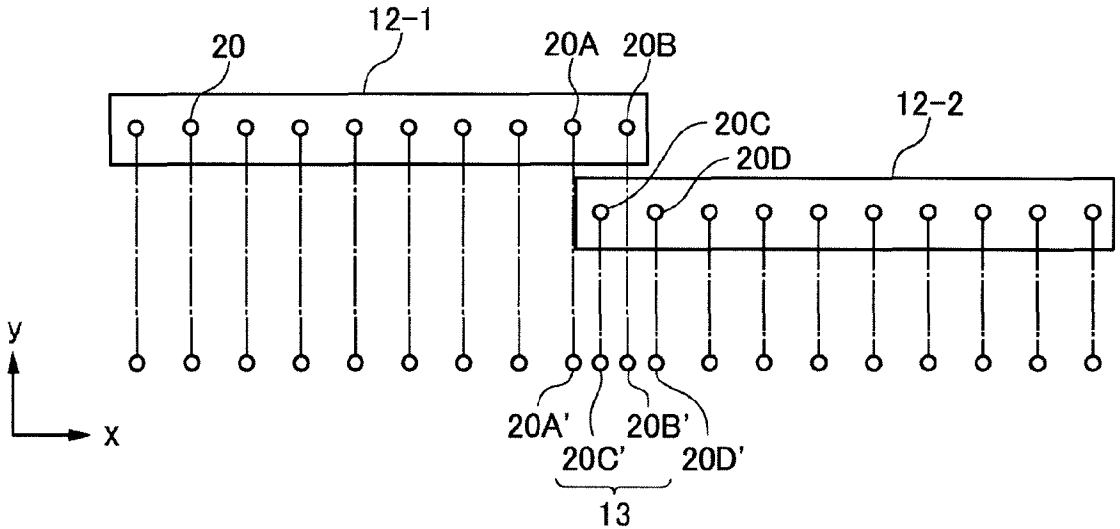

Next, the "joint sections" described above will now be explained in more detail. FIGS. 5A and 5B are diagrams illustrating a nozzle arrangement in a joint section, and FIG. 6A to FIG. 8B are diagrams illustrating liquid ejection control in a joint section.

Mutually adjacent head units 12 have an ejection width (the length in the lengthwise direction of the inkjet head 10 of the nozzle arrangement region 15 (see FIG. 1) where the nozzles 20 which eject liquid are provided) which overlaps with the ejection width of the adjacent head unit 12. The ejection resolution in the region where the ejection widths overlap is a higher resolution than the ejection resolution of the whole inkjet head.

The "high resolution" referred to here means that there is a large number of nozzles capable of ejecting ink in a region even if the ejection pitch is not uniform. In other words, the joint sections 13 have a higher arrangement density of the nozzles 20 than the other portions apart from the joint sections 13.

In FIG. 5A to FIG. 8B, in order to simplify the description, the head units 12-1 and 12-2 are taken to have a structure in which the nozzles 20 are arranged in one row in the lengthwise direction of the inkjet head 10.

FIG. 5A shows a state where the head units 12-1 and 12-2 are assembled without any positioning error. The nozzles 20A and 20B of the head unit 12-1 which are included in the joint section 13 and the nozzles 20C and 20D of the head unit 12-2 which are included in the joint section 13 have matching positions in the lengthwise direction x of the inkjet head 10, without any positional deviation in this direction.

By assembling the head units 12-1 and 12-2 ideally without any positioning error, the nozzle arrangement pitch (nozzle pitch) in the joint section 13 and the nozzle pitch in the other portions coincide with each other, and hence a uniform nozzle pitch is obtained throughout the head unit 12-1 to the head unit 12-2, and discontinuity of ejection in the joint section 13 does not occur when either the nozzles 20A and 20B or the nozzles 20C and 20D are used.

However, it is substantially impossible to assemble the head units 12 without positioning error, and as shown in FIG. 5B, a positioning error of at most ½ of the standard nozzle pitch of the inkjet head 10 occurs.

In FIG. 5B, if a projected nozzle row is considered in which the nozzles 20 belonging to the head unit 12-1 and the nozzles 20 belonging to the head unit 12-2 are projected to an alignment in the lengthwise direction x of the inkjet head 10, the positions of the nozzles 20A' and 20B' which correspond to the nozzles 20A and 20B of the head unit 12-1 included in the joint section 13 and the positions of the nozzles 20C' and 20D' which correspond to the nozzles 20C and 20D of the head unit 12-2 included in the joint section 13 do not coincide, but rather the nozzle 20C' is positioned between the nozzle 20A' and the nozzle 20B', and the nozzle 20D' is positioned at a distance corresponding to a positioning error from the nozzle 20B', on the opposite side of the nozzle 20B' from the nozzle 20A'.

In the joint section 13, a target ejection resolution (the standard ejection resolution of the inkjet head) is achieved by selectively using the nozzles 20A and 20B of the head unit 12-1 which are included in the joint section 13 and the nozzles 20C and 20D of the head unit 12-2 which are included in the joint section 13.

In other words, of the nozzles 20A to 20D which are included in the joint section 13 between the head units 12-1 and 12-2, either one of the nozzles 20A and 20B and either one of the nozzles 20C and 20D can be regarded as a redundant nozzle.

In FIGS. 5A and 5B, in order to simplify the drawing, the number of nozzles 20 included in the joint section 13 between the head units 12-1 and 12-2 is two nozzles each, making a total of four nozzles, but the number of nozzles 20 included in the joint section 13 should be two or more nozzles (one nozzle each from each head unit 12) (detailed description given below).

(Liquid Ejection Control in Joint Section)

In the joint section 13, by carrying out the ejection control described below, discontinuity of ejection caused by discontinuity of the nozzle arrangement in the joint section 13 is diminished.

Figure 6A:
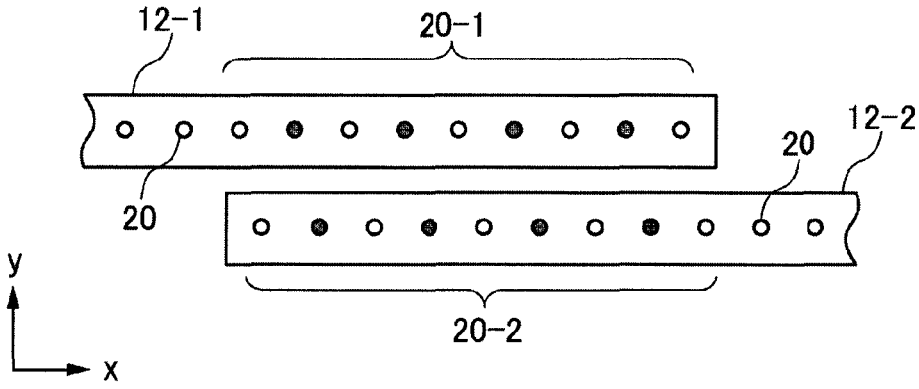
FIGS. 6A and 6B are diagrams illustrating liquid ejection control in a joint section.
Figure 6B:
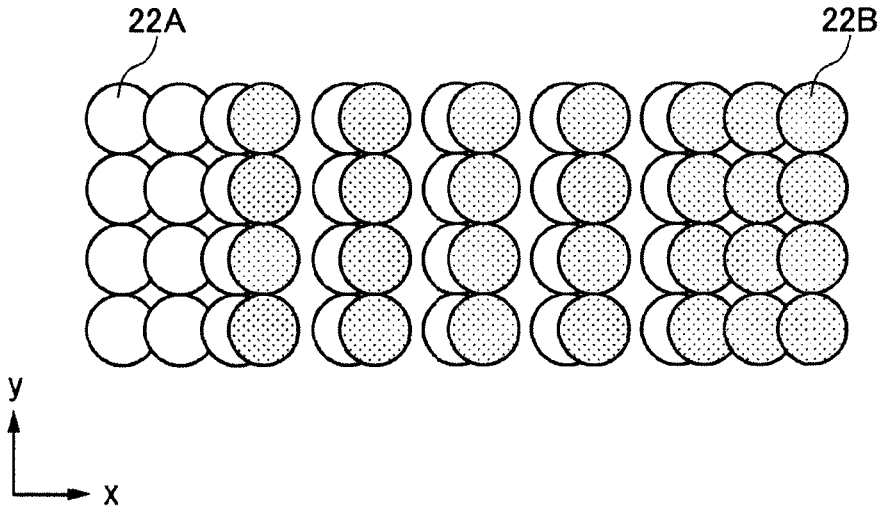

FIGS. 6A and 6B are illustrative diagrams showing a schematic view of one example of liquid ejection control in a joint section 13. FIG. 6A is a diagram showing a relationship of the nozzle arrangement in the joint section 13 between the head unit 12-1 and the head unit 12-2 and FIG. 6B is a diagram showing an arrangement of droplets (dots) 22A ejected by the head unit 12-1 (depicted as white dots in the drawing) and dots 22B ejected by the head unit 12-2 (depicted as hatched dots in the drawing).

In FIG. 6A, the nozzles of the head unit 12-1 included in the joint section 13 are labeled collectively with the reference numeral 20-1, and the nozzles of the head unit 12-2 included in the joint section 13 are labeled collectively with the reference numeral 20-2.

The number of nozzles included in the joint section 13 between the head units 12-1 and 12-2 is taken to be nine nozzles each, making a total of 18 nozzles, and it is supposed that there is positional deviation of ½ of the standard nozzle pitch between the nozzles 20-1 of the head unit 12-1 which are included in the joint section 13 and the nozzles 20-2 of the head unit 12-2 which are included in the joint section 13.

As shown in FIG. 6B, in the ejection control for the joint section 13, every other nozzle of the nozzles 20-1 and 20-2 included in the joint section 13 between the head units 12-1 and 12-2 is thinned out when ejection is performed. In FIG. 6A, the nozzles depicted by black shading are nozzles which do not perform ejection.

In other words, every other nozzle of the nozzles 20-1 and 20-2 is selected as a redundant nozzle, and liquid ejection from the nozzles 20-1 and nozzles 20-2 is controlled in such a manner that the redundant nozzles are not used. On the other hand, the nozzles are not thinned out in the breadthways direction y of the inkjet head 10 (the medium conveyance direction).

Due to this ejection control, the arrangement density of the dots 22 formed by the joint section 13 is matched to the arrangement density of the dots 22 formed by the other portions of the heads. Furthermore, by adjusting the ejection amount of the liquid ejected from the nozzles included in the joint section 13, it is possible to compensate for deviation in the ejection position of the liquid caused by positional deviation of the head units 12 (detailed description given below).

Figure 7A:
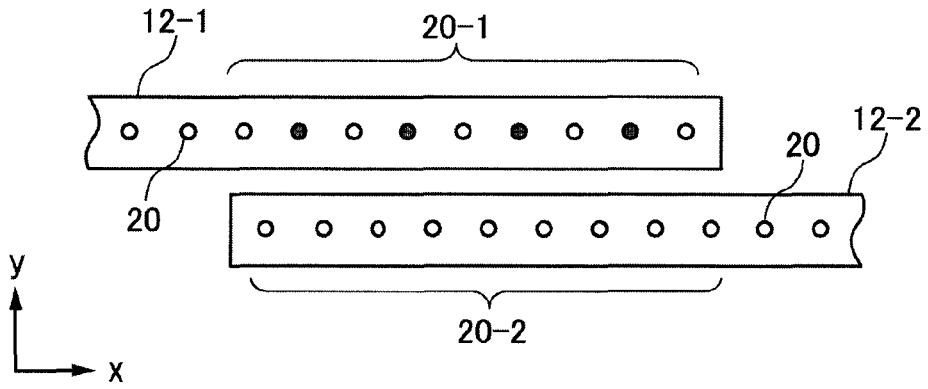
FIGS. 7A and 7B are diagrams illustrating further liquid ejection control in a joint section.
Figure 7B:
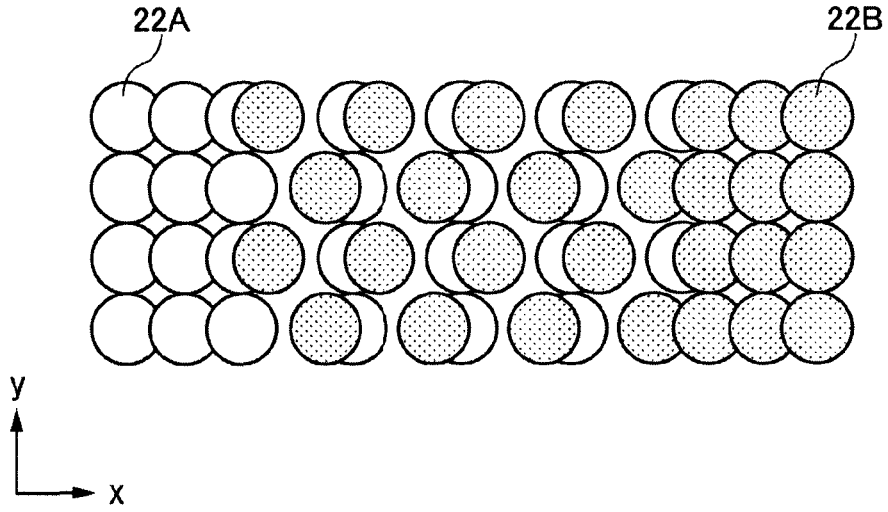

FIGS. 7A and 7B are diagrams illustrating further ejection control in a joint section 13. In FIGS. 7A and 7B, parts which are the same as or similar to FIGS. 6A and 6B are labeled with the same reference numerals and further explanation thereof is omitted here.

In the example shown in FIG. 7B, the nozzles 20-1 of the head unit 12-1 which are included in the joint section 13 perform ejection by thinning out every other nozzle in the lengthwise direction x of the inkjet head 10, and the nozzles 20-2 of the head unit 12-2 which are included in the joint section 13 perform ejection by thinning out every other nozzle in the breadthways direction y in the inkjet head 10.

Due to this ejection control, the arrangement density of the dots 22 formed by the joint section 13 is matched to the arrangement density of the dots 22 formed by the other portions, and furthermore the visibility of density non-uniformities in the dots 22 formed by the joint section 13 is diminished.

Figure 8A:
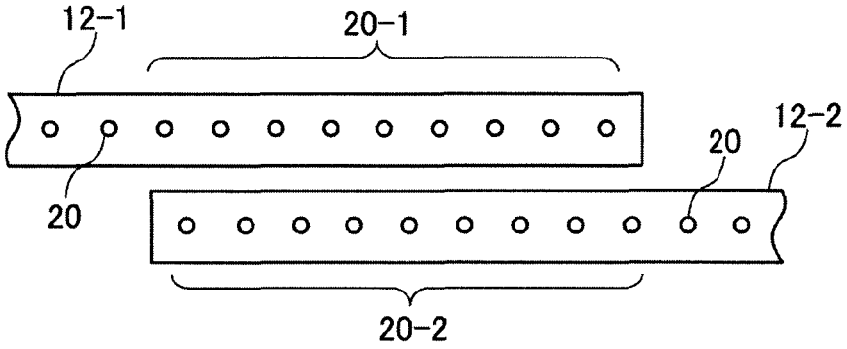
FIGS. 8A and 8B are diagrams illustrating yet further liquid ejection control in a joint section.
Figure 8B:
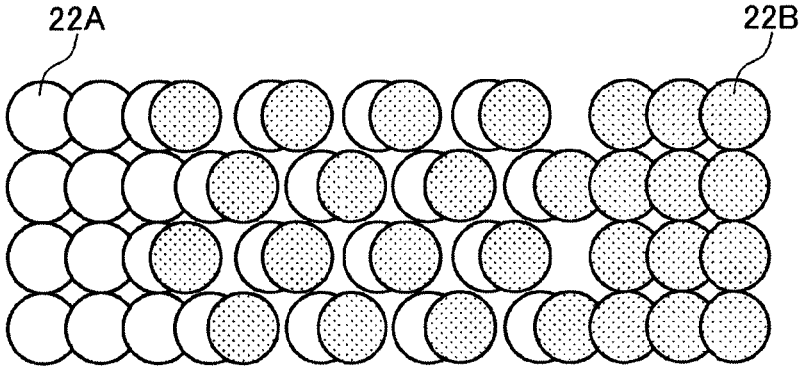

FIGS. 8A and 8B are diagrams showing further ejection control in a joint section 13, in which FIG. 8A is the same as FIG. 6A and FIG. 7A. In the example shown in FIG. 8B, the duty of the nozzles 20-1 and 20-2 included in the joint section 13 between the head units 12-1 and 12-2 is altered gradually.

More specifically, the duty of the nozzles 20-1 of the head unit 12-1 included in the joint section 13 is gradually made smaller and the duty of the nozzles 20-2 of the head unit 12-2 included in the joint section 13 is gradually made larger, whereby the arrangement density of the dots 22A formed by the head unit 12-1 and the dots 22B formed by the head unit 12-2 changes gradually.

As shown in FIG. 6A to FIG. 8B, in a joint section 13 between head units 12, discontinuity of ejection in the joint section 13 is diminished by selectively using the nozzles 20-1 and 20-2 included in the joint section 13 while modifying liquid ejection through thinning control, ejection duty variation, or the like.

The structure of the joint section shown in FIGS. 5A and 5B and the liquid ejection control of the joint section shown in FIG. 6A to FIG. 8B can also be applied to the joint sections 13B between intermediate units 14, as well as the joint sections 13A between head units 12.

(Number of Nozzles Included in Joint Section)

Figure 9:
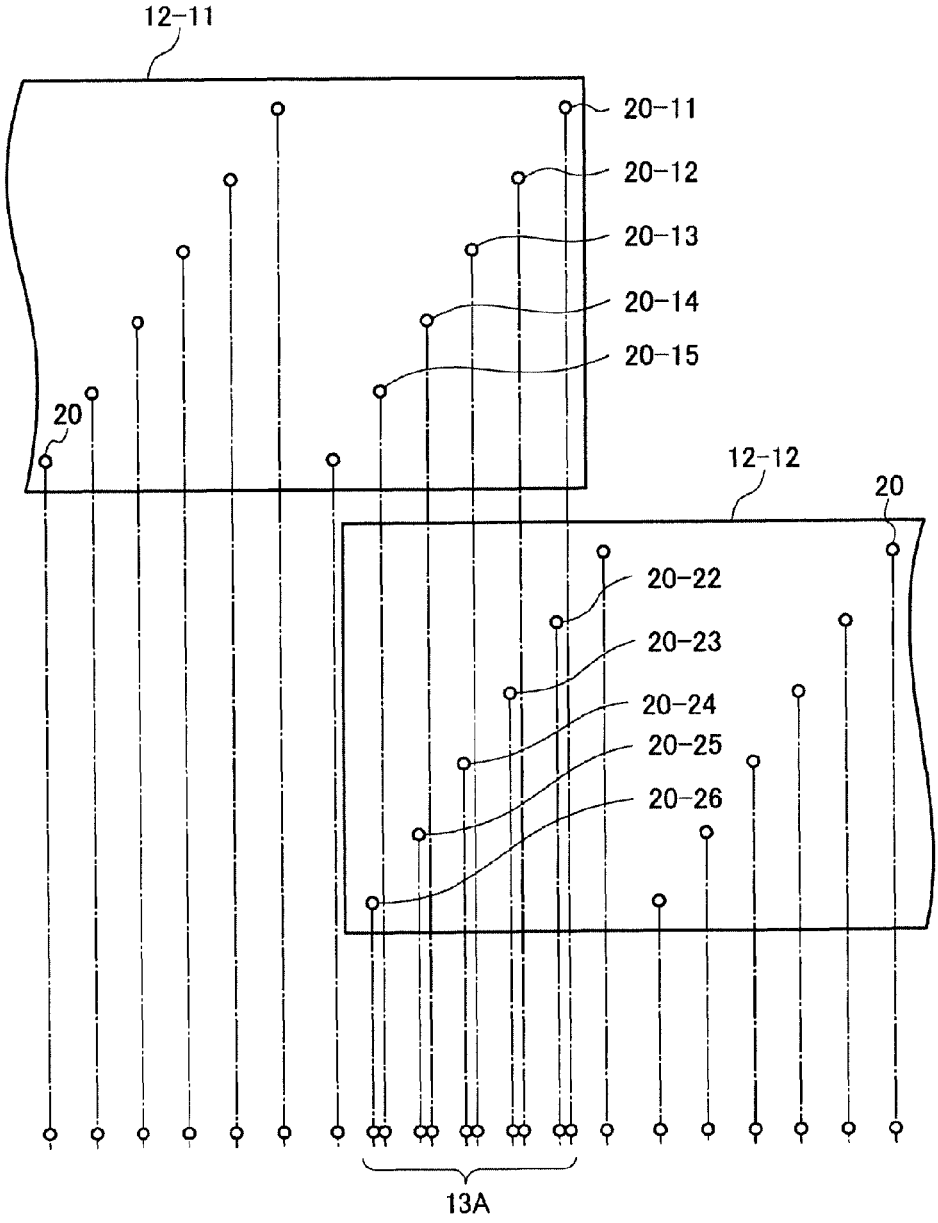
FIG. 9 is an illustrative diagram of a number of nozzles in a joint section between head units.

Next, the number of nozzles included in a joint section 13 will be described in detail. FIG. 9 is an illustrative diagram of the number of nozzles $N_A$ in a joint section 13A between head units 12 (see FIG. 2).

In the example shown in FIG. 9, the total number of nozzles included in a joint section 13A between head units 12 is taken to be ten nozzles. The nozzles 20-11 to 20-15 belonging to the head unit 12-11 and the nozzles 20-22 to 20-26 belonging to the head unit 12-12 are nozzles which are included in the joint section 13A.

By fixing the head units 12 by welding, it is possible to position the head units 12 with high accuracy having a positioning error of approximately 5 micrometers. If the ejection resolution is set to 1200 dpi, the single pixel size (dot pitch) is approximately 20 micrometers (21.2 micrometers), and the achievable positioning error (5 micrometers) is roughly ¼ of the pixel size.

In the ejection control which thins out every other nozzle shown in FIG. 6B, by carrying out ejection control which varies the dot size, it is possible to cover positioning error of approximately 5 micrometers (¼ pixel).

For example, it is possible to alternately arrange large droplets and small droplets by controlling liquid ejection so as to form dots having a diameter of 20 micrometers (a small droplet, one standard pixel), 25 micrometers (a medium droplet, 1.25 times one standard pixel), and 40 micrometers (a large droplet, 2 times one standard pixel).

If the dot pitch is 20 micrometers, then if there is a positional deviation of 5 micrometers, the actual dot pitch becomes 25 micrometers. If large droplets and small droplets are aligned alternately, then a 5-micrometer overlap is in principle ensured between the dots.

To summarize the foregoing, provided that the positional deviation is approximately 5 micrometers (¼ pixel), it is possible to cover the joint section by employing ejection control to selectively eject different dot sizes, and in terms of the number of nozzles included in the joint section, this can be achieved with an overlap of 2 nozzles to approximately 10 nozzles.

For instance, in the joint sections 13A between the plurality of head units 12, when positional deviation of approximately 5 micrometers (¼ pixel) occurs, then the visibility of density non-uniformities occurring due to positional deviation of the head units 12 in the joint sections 13A is diminished. Since 5 micrometers is a small amount which is barely visible, then it is possible to reduce the visibility of density non-uniformities and to connect together a plurality of head units 12 with an overlap from a minimum nozzle number of 2 nozzles to approximately 10 nozzles.

Figure 10:
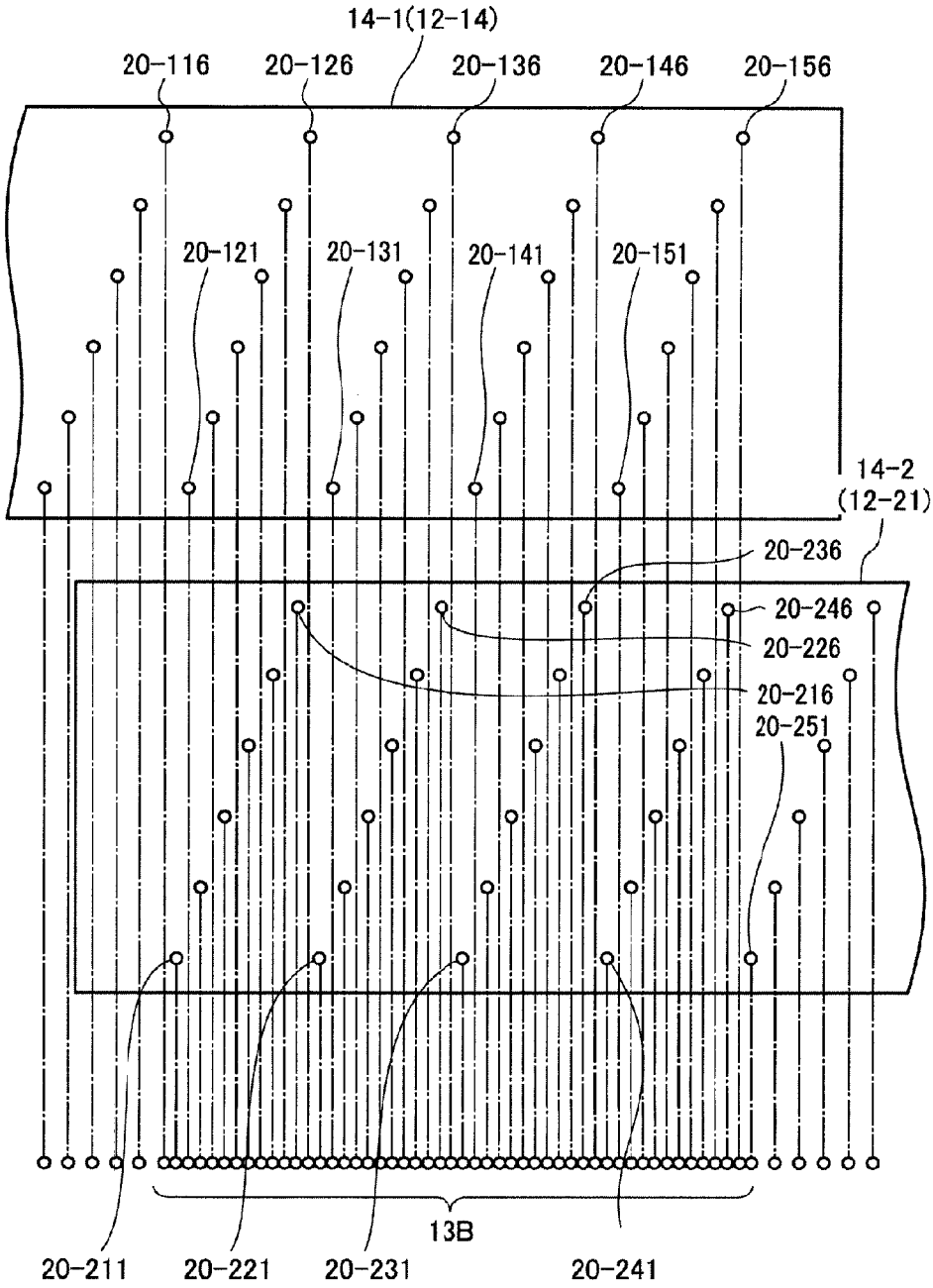
FIG. 10 is an illustrative diagram of a number of nozzles in a joint section between intermediate units.

FIG. 10 is an illustrative diagram of the number of nozzles $N_B$ in a joint section 13B between intermediate units 14 (see FIG. 2). In FIG. 10, for illustrative purposes, the effective nozzle pitch is ½ of that in FIG. 9.

In the example shown in FIG. 10, the total number of nozzles included in a joint section 13B between intermediate units 14 is taken to be fifty nozzles. In other words, the nozzles included in the joint section 13B between the intermediate units 14 are: the uppermost nozzle 20-116 of the first column from the left of the intermediate unit 14-1 (the head unit 12-14), the nozzles 20-121 to 20-126 of the second column from the left, the nozzles 20-131 to 20-136 of the third column from the left, the nozzles 20-141 to 20-146 of the fourth column from the left, the nozzles 20-151 to 20-156 of the fifth column from the left, the nozzles 20-211 to 20-216 of the first column from the left of the head unit 12-21, the nozzles 20-221 to 20-226 of the second row from the left, the nozzles 20-231 to 20-236 of the third row from the left, the nozzles 20-241 to 20-246 of the fourth row from the left, and the bottommost nozzle 20-251 of the fifth row from the left.

As described previously, the intermediate unit 14 is not required to have greater positioning accuracy than the head unit 12, and positional deviation of at most ½ pixel (½ of the dot pitch) can be envisaged. For example, if the liquid ejection resolution is taken to be 1200 dpi, then a positional deviation of at most 10 micrometers is produced.

It is difficult to cover positional deviation of 10 micrometers with the selective ejection of three different dot sizes described above, and therefore it is necessary to successively change the ratio of the dots ejected from the head unit 12-14 and the dots ejected from the head unit 12-21.

For example, a conceivable mode is one in which the ratio of the dots ejected from the head unit 12-14 and the dots ejected from the head unit 12-21 is changed successively in three steps, such as 4:0, 3:1, 2:2, 1:3, 0:4.

This dot ratio could also be changed in two to five steps. If the total number of nozzles required per step is the same as the number of nozzles $N_A$ included in the joint section 13A between the head units 12, then in the case of two steps, a total of $2\times N_A$ nozzles is required and in the case of five steps, a total of $5\times N_A$ nozzles is required.

In other words, the number of nozzles $N_B$ included in the joint section 13B between the intermediate units 14 is at least two times the number of nozzles $N_A$ included in the joint section 13A between the head units 12, and this number of nozzles $N_B$ is given by multiplying the number of steps of the dot ratio by the number of nozzles $N_A$ included in the joint section 13A between the head units 12.

The length of the joint section 13 in the lengthwise direction x of the inkjet head 10 is set to a width which is not readily visible to the human eye (for example, 0.5 millimeters).

(Description of Liquid Supply Channels)

It is possible to adopt a composition in which liquid supply channels which are connected to an external liquid supply system of the inkjet head 10 are provided respectively for each intermediate unit 14. Supply flow channels are branched off to each head unit 12 from the liquid supply channel of each intermediate unit 14. By adopting this composition, it becomes easy to replace each intermediate unit 14 individually.

[Method of Fixing Head Unit]

(Fixing with Adhesive)

FIGS. 11A and 11B are illustrative diagrams showing a schematic view of a fixing method for fixing a head unit 12 to an intermediate unit 14. FIG. 11A is a diagram of a head unit 12 (intermediate unit 14) viewed in a breadthways direction of the inkjet head 10 from a surface perpendicular to the nozzle surface (viewed in the upward direction in FIG. 1), and FIG. 11B is a plan diagram of a head unit 12 viewed from the nozzle surface 30.

As described previously, for the method of fixing the head unit 12 to the intermediate unit 14, bonding with adhesive or integrated forming of the head unit 12 and the intermediate unit 14 is employed so as to achieve highly accurate positioning of the head unit 12.

In the examples shown in FIGS. 11A and 11B, a mode is depicted in which a head unit 12 is fixed to an intermediate unit 14 by using adhesive.

Positioning holes 32 are provided in the head unit 12, and positioning pins 34 for the head unit 12 are provided in the intermediate unit 14. An adhesive 36 is coated onto the bonding surface of the intermediate unit 14 with the head unit 12, and the fixing position of the head unit 12 is specified accurately by inserting the holes 32 of the head unit 12 onto the pins 34 of the intermediate unit 14.

When the head unit 12 has been positioned on the intermediate unit 14, heat treatment is carried out at a prescribed temperature in order to cure the adhesive. By forming the region where the adhesive 36 is coated as a recess section, the adhesive is prevented from oozing out.

FIG. 11A shows a state where adhesive 36 is applied to the intermediate unit 14, but the adhesive 36 may also be applied to the head unit 12 or to both the head unit 12 and the intermediate unit 14.

Furthermore, in FIGS. 11A and 11B, a mode is depicted in which the positioning holes 32 and pins 34 are provided on a diagonal of the head unit 12 which has a square planar shape, but it is sufficient for a positioning hole 32 and pin 34 to be provided in at least one apex of the head unit 12.

Moreover, instead of positioning by using holes 32 in the head unit 12 and pins 34 in the intermediate unit 14, it is also possible to adopt a mode in which interlocking shapes (for example, a projecting shape and a recess shape) are provided on the bonding surface of the head unit 12 and the bonding surface of the intermediate unit 14.

(Integrated Forming)

Although not shown in the drawings, it is also possible to position the head units 12 with high accuracy by forming a plurality of head units 12 belonging to an intermediate unit 14, and an intermediate unit 14, in an integrated fashion.

For example, a conceivable mode is one in which a unit including a plurality of head units 12 and an intermediate unit 14 formed in integrated fashion is created by lamination of thin films (cavity plates). The thin plates forming a thin layer structure can be formed with high accuracy by using a thin film forming process.

By forming the head units 12 and the intermediate unit 14 in an integrated fashion, highly accurate positioning of the head units 12 is achieved.

[Method of Fixing Intermediate Unit]

Next, the method of fixing the intermediate units 14 will be described. The inkjet head 10 shown in the present embodiment employs a method based on a mechanical fixing member for fixing the intermediate units 14, in such a manner that the intermediate units 14 can be replaced independently.

(Screw Fastening)

Figure 12:
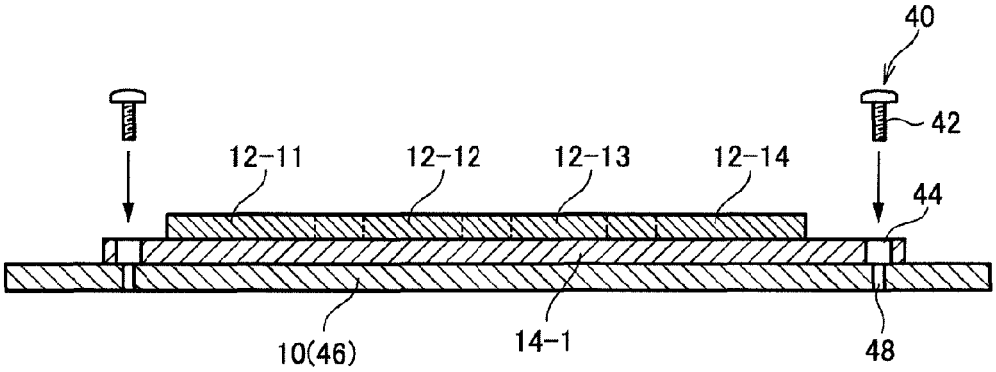
FIG. 12 is an illustrative diagram showing a schematic view of a method of fixing an intermediate unit.

FIG. 12 is an illustrative diagram showing a schematic view of a method of fixing an intermediate unit 14 by screw fastening. FIG. 12 is a side view of the intermediate unit 14-1 in FIG. 1, as observed in the downward direction in FIG. 1.

As shown in FIG. 12, through holes 44 into which the shafts 42 of screws 40 can be inserted are provided in an intermediate unit 14-1 to which the head units 12-1 to 12-4 are fixed. Furthermore, screw holes 48 formed with a screw thread corresponding to the thread peaks of the screws 40 are provided in the inkjet head 10 (a fixing section 46 to which the intermediate unit 14-1 is fixed).

By aligning the positions of the intermediate unit 14-1 and the inkjet head 10 (fixing section 46) by means of a prescribed positioning jig and then fastening the screws 40, the intermediate unit 14-1 is fixed to the inkjet head 10.

(Fixing by Elastic Member)

Figure 13:
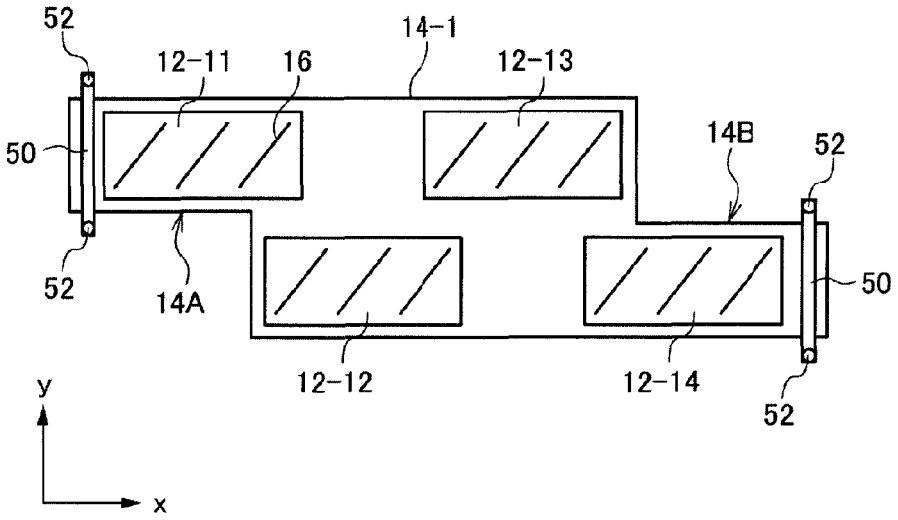
FIG. 13 is an illustrative diagram of a further method of fixing an intermediate unit.

FIG. 13 is an illustrative diagram showing a schematic view of a method of fixing an intermediate unit 14 by using elastic members (leaf springs) 50. FIG. 13 is a planar perspective diagram of the intermediate unit 14-1 viewed from the opposite side to the nozzle surface, similarly to FIG. 1, and elements which are only visible from the nozzle surface, such as the head units 12, are depicted by solid lines, similarly to FIG. 2.

As shown in FIG. 13, when the head units 12-11 to 12-14 have been fixed to the intermediate unit 14, either end portion of the intermediate unit 14 in the lengthwise direction x of the inkjet head 10 (the projecting sections 14A and 14B) is fixed by leaf springs 50.

The intermediate unit 14-1 is pushed onto the inkjet head 10 thereby fixing the intermediate unit 14-1 to the inkjet head 10, by the elastic force (restoring force) of the leaf springs 50 which are fixed to the inkjet head 10 by fixing members 52.

(Fixing by Insert Fitting)

Figure 14:
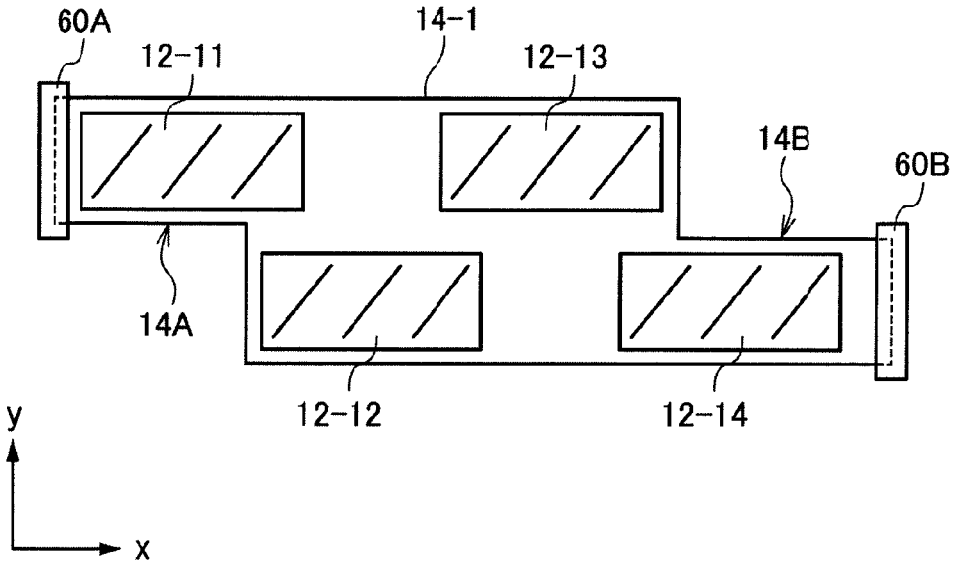
FIG. 14 is an illustrative diagram of yet a further method of fixing an intermediate unit.

FIG. 14 is an illustrative diagram showing a schematic view of a method of fixing an intermediate unit 14 by insert fitting. FIG. 14 is a planar perspective diagram of an intermediate unit 14-1 viewed from the opposite side to the nozzle surface, similarly to FIG. 1, and elements which are only visible from the nozzle surface, such as the head units 12, are depicted by solid lines, similarly to FIG. 2.

As shown in FIG. 14, when the head units 12-11 to 12-14 have been fixed to the intermediate unit 14, either end portion of the intermediate unit 14 in the lengthwise direction x of the inkjet head 10 (the projecting sections 14A and 14B) is fixed by insert fitting sections 60 (60A, 60B).

Of the insert fitting sections 60A, 60B shown in FIG. 14, one (60A) is fixed to the inkjet head 10, and the other (60B) can be adjusted in position in the lengthwise direction x of the inkjet head 10.

Furthermore, the insert fitting sections 60A, 60B have a structure capable of fitting together with the end portions of the intermediate unit 14 (the projecting sections 14A and 14B). The intermediate unit 14-1 is fixed to the inkjet head 10 by inserting the projecting section 14A of the intermediate unit 14-1 into the insert fitting section 60A which is fixed to the inkjet head 10, fitting the insert fitting section 60B onto the projecting section 14B of the intermediate unit 14-1, moving the insert fitting section 60B towards the insert fitting section 60A, and fixing the position of the insert fitting section 60B when the intermediate unit 14-1 is sandwiched between the insert fitting sections 60A and 60B.

It is also possible to adopt a fixing method other than the methods described above for fixing the intermediate unit 14. For example, it is also possible to adopt another mechanical fixing method, such as abutment, or push fitting using elastic components.

The positioning accuracy of the intermediate unit 14 in a mechanical fixing method such as that described above is approximately 20 micrometers to 50 micrometers. Supposing an ejection resolution of 300 dpi to 600 dpi, the dot pitch (nozzle pitch) is 40 (42.3) micrometers to 80 (84.7) micrometers, and a positioning accuracy of ½ of the dot pitch (20 micrometers to 40 micrometers), which is an issue in relation to liquid ejection non-uniformities, can be guaranteed.

However, if the resolution exceeds 600 dpi, for example, if the ejection resolution is 1200 dpi, then the dot pitch is approximately 20 micrometers. In this case, it is difficult to guarantee a positioning accuracy of ½ of the dot pitch (approximately 10 micrometers) which is an issue in relation to liquid ejection non-uniformities.

Consequently, by increasing the total number of nozzles $N_B$ in the joint sections 13B between intermediate units 14, discontinuity of ejection in the joint sections 13B between the intermediate units 14 is avoided.

When choosing the nozzles to be used selectively in a joint section 13B between intermediate units 14, from the head unit 12 belonging to one intermediate unit 14 and the head unit 12 belonging to the other intermediate unit 14, even if there is a large positional deviation between the adjacent intermediate units 14 in the joint section 13B between the intermediate units 14, it is still possible to diminish discontinuity of the image (density) caused by this positional deviation, by performing droplet ejection alternately from either intermediate unit 14 (head unit 12) or by adjusting the dot sizes in the periphery of the joint section 13B between the intermediate units 14.

However, if this diminishment of the image discontinuity is carried out in a narrow region (a region of few joining nozzles), then the change per unit length in the joint section 13B becomes larger and hence the discontinuity in the image becomes visible. By having a plurality of diminishment levels for positional deviation between the adjacent intermediate units 14 and by raising the overall number of nozzles and gradually switching the nozzles, it is possible to reduce the visibility of the discontinuity of the image.

In the inkjet head 10 which is composed as described above, the number of redundant nozzles is reduced by arranging a small number of nozzles 20 in the joint sections 13A between head units 12 which are positioned with high accuracy, and furthermore the positioning accuracy required when replacing the intermediate units 14 is made less strict by arranging a larger number of nozzles 20 in the joint sections 13B between the intermediate units 14, and hence replacement of an intermediate unit 14 can be performed easily, thus helping to reduce the work involved in replacement of the intermediate units 14.

More specifically, the inkjet head 10 is composed in such a manner that the total number of nozzles $N_A$ included in the joint sections between head units 12 and the total number of nozzles $N_B$ included in the joint sections 13B between intermediate units 14 satisfy the relationship $N_A<N_B$, whereby reduction in the number of redundant nozzles in the joint sections can be achieved, while also making the positioning accuracy required in the replacement of individual intermediate units 14 less strict.

Moreover, by setting the total number of nozzles $N_B$ included in the joint sections 13B between the intermediate units 14 to not less than $2\times N_A$ and $5\times N_A$, it is possible to respond to cases where the liquid ejection resolution exceeds 600 dpi (for example, 1200 dpi).

(Ejection Method of Inkjet Head)

The ejection method of the inkjet head 10 described in the present embodiment may employ a piezoelectric method using distortion of a piezoelectric element, or may employ a thermal method using a film boiling effect of ink inside a liquid chamber which is connected to a nozzle.

An ejection element in a piezoelectric method may adopt a mode including a nozzle, a pressure chamber connected to the nozzle, and a piezoelectric element formed in a wall constituting the pressure chamber. Furthermore, an ejection element in a thermal method may adopt a mode including a nozzle, a liquid chamber connected to the nozzle, and a heating element (heater) which heats liquid inside the liquid chamber.

MODIFICATION EXAMPLES

Figure 15:
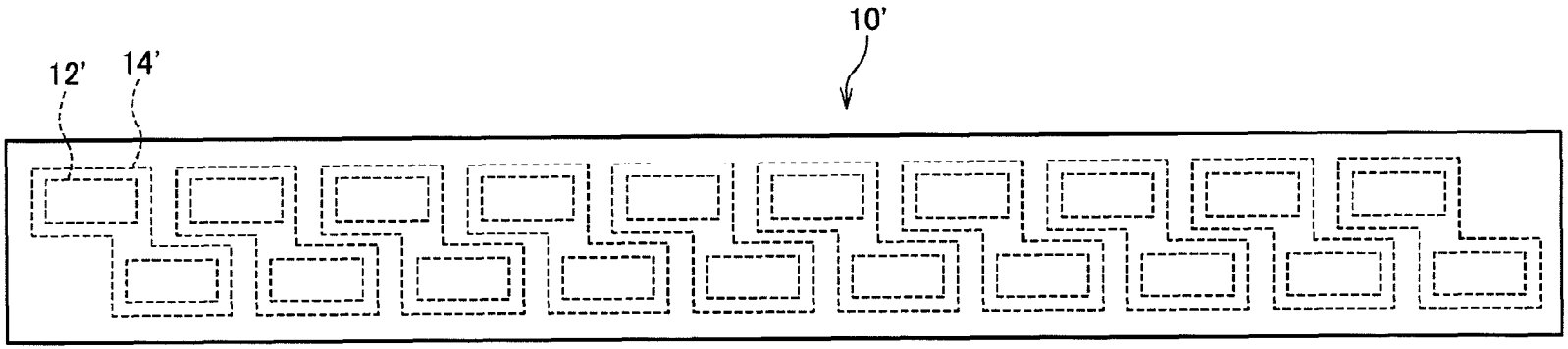
FIG. 15 is a plan diagram showing a modification example of an intermediate unit.
Figure 16:
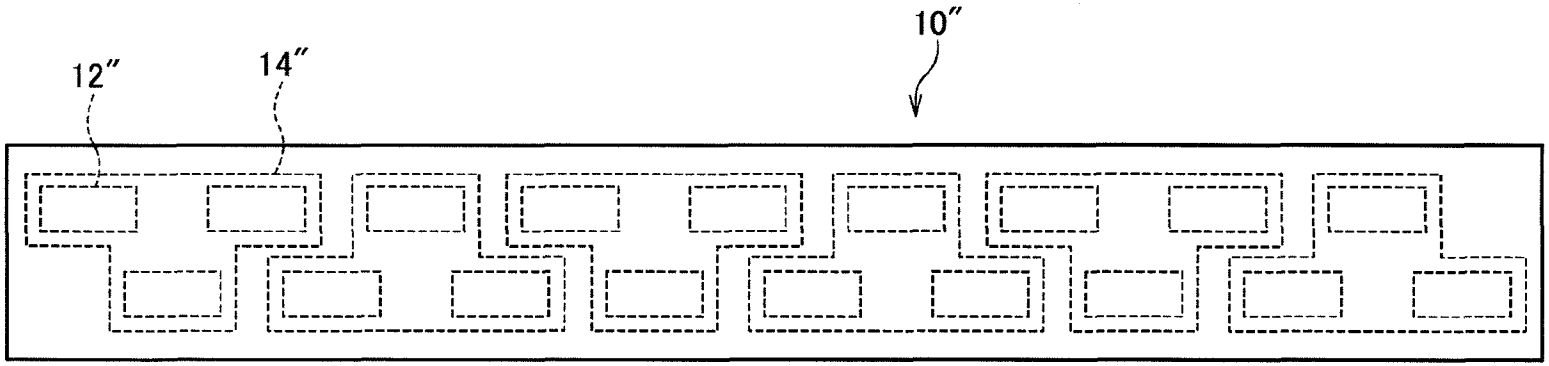
FIG. 16 is a plan diagram showing a further modification example of an intermediate unit.

FIG. 15 and FIG. 16 are plan view perspective diagrams showing an approximate composition of an inkjet head relating to modification examples of the present invention. The inkjet head 10' shown in FIG. 15 is a mode in which one intermediate unit 14' is equipped with two head units 12, and the planar shape of the intermediate unit 14' is formed by two rectangular shapes which are staggered in the long edge direction.

Furthermore, the inkjet head 10" shown in FIG. 16 is a mode in which one intermediate unit 14" is equipped with three head units 12, and the planar shape of the intermediate unit 14" is a projecting shape (peak shape).

When a large number of head units 12 are provided in an intermediate unit 14, it is possible to reduce the number of intermediate units 14 which are provided in one inkjet head 10, and therefore the installation variations between the intermediate units 14 in the whole inkjet head 10 can be reduced.

On the other hand, by making the number of head units 12 provided in the intermediate unit 14 smaller, than it is possible to suppress variation in the fixing positions of the head units 12 in the intermediate unit 14.

The number of head units 12 provided in an intermediate unit 14 is not limited to two to four, and it is also possible to adopt a mode in which five or more head units 12 are provided in one intermediate unit.

[Example of Composition of Apparatus]

Figure 17:
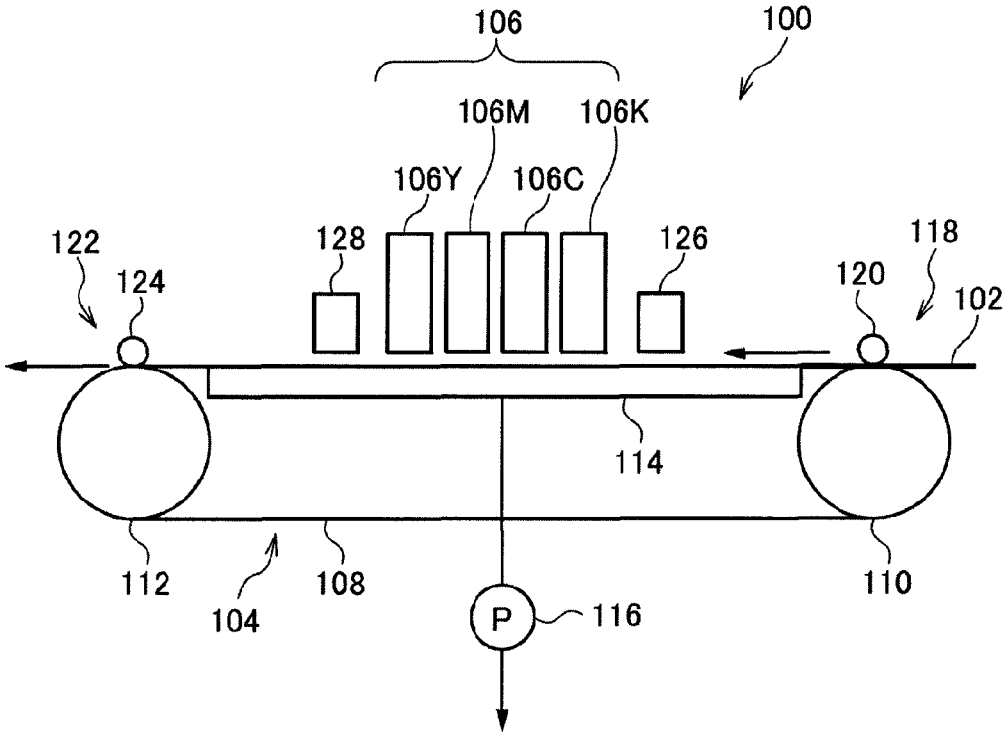
FIG. 17 is a general schematic drawing of an inkjet recording apparatus to which the liquid ejection head shown in FIG. 1 to FIG. 9 is applied.

There follows an example of the composition of an apparatus in which the inkjet head 10 (10', 10") described above is applied. FIG. 17 is a schematic drawing of an inkjet recording apparatus including an inkjet head relating to the present invention.

The inkjet recording apparatus 100 shown in FIG. 17 includes a recording medium conveyance unit 104 which holds and conveys a recording medium 102, and a print unit 106 equipped with inkjet heads 106K, 106C, 106M and 106Y which eject color inks corresponding to K (black), C (cyan), M (magenta) and Y (yellow) onto a recording medium 102 which is held by the recording medium conveyance unit 104.

The inkjet head 10 (10', 10") described above is employed for the inkjet heads 106K, 106C, 106M and 106Y shown in FIG. 17.

The recording medium conveyance unit 104 includes: an endless conveyance belt 108 which is provided with a plurality of suction holes (not illustrated) in a recording medium holding region where a recording medium 102 is held; conveyance rollers (a drive roller and idle roller) 110 and 112 about which the conveyance belt 108 is wrapped; a chamber 114 which is provided on a rear side of the conveyance belt 108 in the recording medium holding region (on the surface opposite to the recording medium holding surface where the recording medium 102 is held), and which generates negative pressure at the suction holes (not illustrated) that are provided in the recording medium holding region; and a vacuum pump 116 which generates negative pressure in the chamber 114.

A pressing roller 120 for preventing floating of the recording medium 102 is provided in an introduction unit 118 where a recording medium 102 is introduced, and furthermore, a pressing roller 124 is also provided in an output unit 122 where the recording medium 102 is output.

The recording medium 102 which has been introduced via the introduction unit 118 receives negative pressure from the suction holes provided in the recording medium holding region, and is thereby held on the recording medium holding region of the conveyance belt 108.

A temperature adjustment unit 126 for adjusting the surface temperature of the recording medium 102 to a prescribed range is provided on the conveyance path of the recording medium 102, in a stage prior to the print unit 106 (to the upstream side in terms of the recording medium conveyance direction), and furthermore, a reading apparatus (reading sensor) 128 for reading an image recorded on the recording medium 102 is provided in a stage after the print unit 106 (to the downstream side in terms of the recording medium conveyance direction).

The recording medium 102 which has been introduced via the introduction unit 118 is suctioned and held on the recording medium holding region of the conveyance belt 108, and after undergoing temperature adjustment processing by the temperature adjustment unit 126, image recording is carried out by the print unit 106.

The recorded image (test pattern) is read out by the read apparatus 128, and the recording medium 102 on which an image has been recorded is then output from the output unit 122.

(Composition of the Print Unit)

The inkjet heads 106K, 106C, 106M and 106Y provided in the print unit 106 are full line type inkjet heads in which a plurality of nozzles are arranged through a length exceeding the entire width of the recording medium 102.

The inkjet heads 106K, 106C, 106M and 106Y are arranged in this order from the upstream side of the recording medium conveyance direction. It is possible to record an image over the whole area of the recording medium 102 by means of a single-pass method in which the full line type inkjet heads 106K, 106C, 106M and 106Y and the recording medium 102 are moved just once relatively to each other.

The print unit 106 is not limited to the mode described above. For instance, it is also possible to include inkjet heads 106 corresponding to LC (light cyan) and LM (light magenta). Furthermore, the arrangement sequence of the inkjet heads 106K, 106C, 106M and 106Y may also be varied appropriately.

In the present embodiment, a mode is described in which full line type recording heads are provided, but it is also possible to employ a serial method in which image recording is performed over the whole area of a recording medium 102 by repeating an operation of carrying out image recording in a width direction of the recording medium 102 by performing a scanning action of a short inkjet head in the width direction, and when one image recording action in this width direction has been completed, moving the recording medium 102 by a prescribed amount in a direction perpendicular to the scanning direction of the inkjet head, and carrying out image recording while performing a scanning action of the inkjet head in the next region.

(Composition of Control System)

Figure 18:
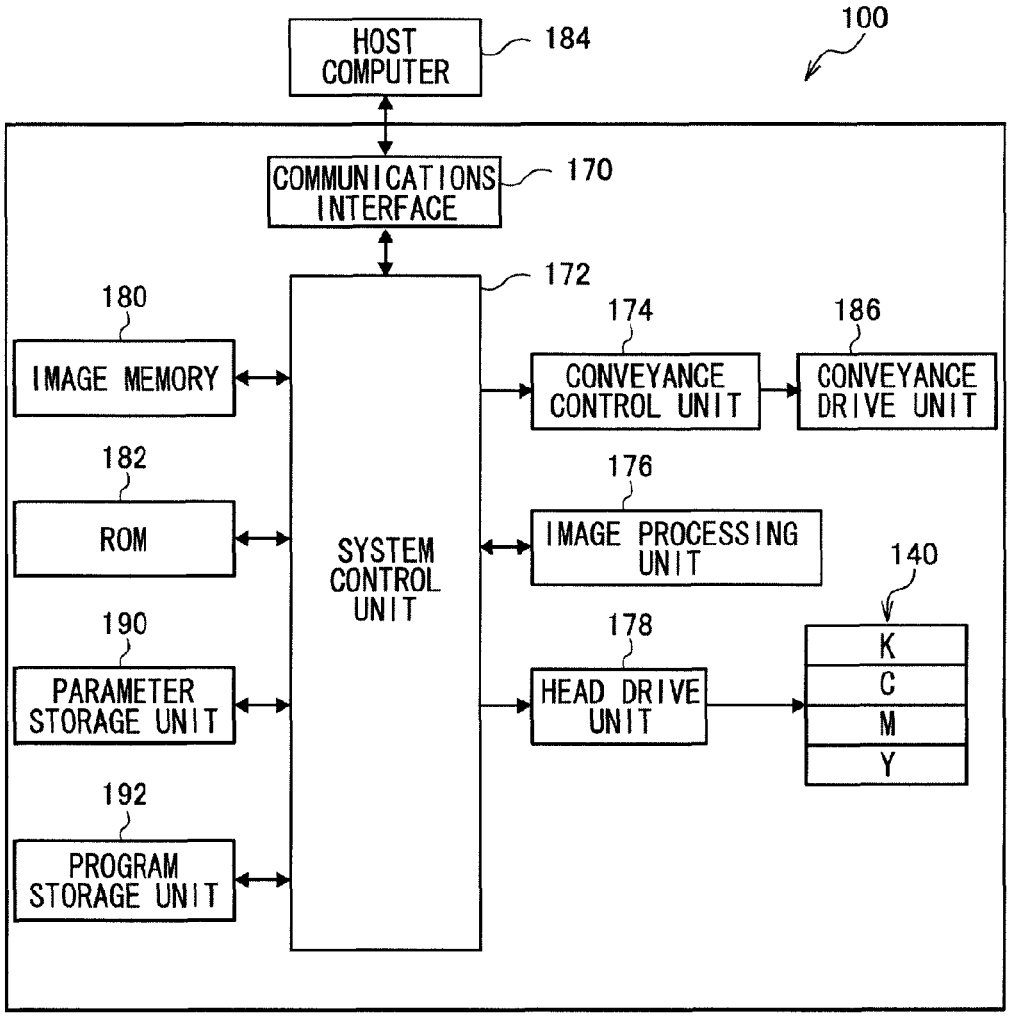
FIG. 18 is a block diagram showing an approximate configuration of the control system of the inkjet recording apparatus shown in FIG. 17.

Next, a control system of the inkjet recording apparatus 100 described in the present embodiment will be explained. FIG. 18 is a block diagram showing the approximate composition of the control system of the inkjet recording apparatus 100.

The inkjet recording apparatus 100 includes a communications interface 170, a system controller 172, a conveyance control unit 174, an image processing unit 176, and a head driving unit 178, as well as an image memory 180 and a ROM 182.

The communications interface 170 is an interface unit for receiving raster image data which is transmitted by a host computer 184. The communications interface 170 may employ a serial interface, such as a USB (Universal Serial Bus), or a parallel interface, such as a Centronics device. It is also possible to install a buffer memory (not illustrated) for achieving high-speed communications in the communications interface 170.

The system controller 172 is constituted by a central processing unit (CPU) and peripheral circuits of same, and the like, and functions as a control apparatus which controls the whole of the inkjet recording apparatus 100 in accordance with a prescribed program, as well as functioning as a calculating apparatus which performs various calculations and also functioning as a memory controller for the image memory 180 and the ROM 182.

In other words, the system controller 172 controls the various sections, such as the communications interface 170, the conveyance control unit 174, and the like, as well as controlling communications with the host computer 184 and read and writing to and from the image memory 180 and the ROM 182, and the like, and generating control signals which control the respective units described above.

The image data sent from the host computer 184 is input to the inkjet recording apparatus 100 via the communications interface 170, and prescribed image processing is carried out by the image processing unit 176.

The image processing unit 176 is a control unit which has signal (image) processing functions for carrying out various treatments, corrections and other processing in order to generate a signal for controlling printing from the image data, and which supplies the generated print data (dot data) to the head drive unit 178.

When prescribed signal processing has been carried out in the image processing unit 176, the ejected droplet volume (droplet ejection volume) and the ejection timing of the inkjet head are controlled via the head drive unit 178 on the basis of the print data (halftone image data). The head drive unit 178 may be constituted by a plurality of blocks provided for each intermediate unit 14, or for each head unit 12.

By this means, a desired dot size and dot arrangement are achieved. The head drive unit 178 shown in FIG. 18 may also include a feedback control system for maintaining uniform drive conditions in the inkjet head.

The conveyance control unit 174 controls the conveyance timing and conveyance speed of the recording medium 102 (see FIG. 17) on the basis of print data generated by the image processing unit 176. The conveyance drive unit 186 in FIG. 18 includes a motor which drives a drive roller 110 (112) of a recording medium conveyance unit 104 that conveys the recording medium 102, and the conveyance control unit 174 functions as a driver for this motor.

The image memory (temporary storage memory) 180 includes the functions of a temporary storage device for temporarily storing image data input via the communications interface 170, and the functions of a development area for various programs stored in the ROM 182 and a calculation work area for the CPU (for example, a work area for the image processing unit 176). A volatile memory (RAM) which can be read from and written to sequentially is used as the image memory 180.

The ROM 182 stores a program which is executed by the CPU of the system controller 172, and various data and control parameters, and the like, which are necessary for controlling the respective sections of the apparatus, and performs reading and writing of data via the system controller 172. The ROM 182 is not limited to a memory such as a semiconductor element, and may also employ a magnetic medium, such as a hard disk. Furthermore, the storage unit may also include an external interface and use a detachable storage medium.

The parameter storage unit 190 stores various control parameters which are necessary for the operation of the inkjet recording apparatus 100. The system controller 172 reads out parameters required for control purposes, as appropriate, and updates (rewrites) parameters as and where necessary.

The program storage unit 192 is a storage device which stores control programs for operating the inkjet recording apparatus 100. In controlling the respective units of the apparatus, the system control unit 172 (or respective units of the apparatus themselves) reads out the required control program from the program storage unit 192 and the control program is duly executed.

The scope of application of the present invention is not limited to an inkjet recording apparatus which forms a color image on a recording medium. For example, the present invention may also be applied broadly to liquid ejection apparatuses which eject liquid onto a medium by an inkjet method, such as pattern forming apparatuses which form a prescribed pattern (mask pattern, wiring pattern) by a functional liquid containing resin particles and metal particles.

[Appendix]

As has become evident from the detailed description of the embodiment of the present invention given above, the present specification includes disclosure of various technical ideas including at least the inventions described below.

(Invention 1): A liquid ejection head, comprising: a head unit provided with a plurality of nozzles which eject liquid; and an intermediate unit provided with a fixing section to which a plurality of the head units are fixed, wherein the intermediate unit is installed in such a manner that intermediate units can be replaced independently, the intermediate unit has a structure in which portions of the nozzles of two head units that are mutually adjacent in a second direction perpendicular to a first direction are mutually overlapped in the first direction, and positions of two head units that are mutually adjacent in the second direction are not overlapped in the second direction; and in a joint section where portions of nozzles of head units that are mutually adjacent in the second direction are overlapped, a relationship between a total number of nozzles $N_A$ included in a joint section between the head units belonging to a same intermediate unit and a total number of nozzles $N_B$ included in a joint section between the intermediate units satisfies: $N_A<N_B$.

According to the present invention, it is possible to reduce wasted nozzles in a joint section by reducing the total number of nozzles $N_A$ included in a joint section between head units that are positioned and fixed with high accuracy, while diminishing discontinuity of liquid ejection in joint sections between head units and joint sections between intermediate units, and furthermore, it is possible to make the replacement of each intermediate unit easy and hence to reduce the work involved in replacing intermediate units by further increasing the total number of nozzles $N_B$ included in joint sections between intermediate units which are fixed with less strict positioning accuracy than the head units.

Desirably, all of the head units have the same composition. Furthermore, desirably, all of the intermediate units have the same composition.

The arrangement of the nozzles provided in the head units may adopt a matrix arrangement, a one-row arrangement in the first direction, or a two-row staggered arrangement in the first direction.

(Invention 2): The liquid ejection head as defined in the invention 1, wherein the head units have a uniform nozzle pitch in a projected nozzle row obtained by projecting all of the nozzles to an alignment in the first direction.

According to this mode, a prescribed ejection resolution is achieved in each head unit.

(Invention 3): In the liquid ejection head described in the invention 2, desirably, the head units are fixed to the intermediate unit with a positioning accuracy of not more than ¼ of the nozzle pitch in the projected nozzle row.

According to this mode, the head units are positioned and fixed with high accuracy with respect to the intermediate unit.

In this mode, desirably, the head units are positioned and fixed with a positioning accuracy of not more than 1/10 of the nozzle pitch of the projected nozzles.

(Invention 4): The liquid ejection head as defined in the invention 4, wherein the plurality of intermediate units are fixed with a positioning accuracy lower than the positioning accuracy of fixing of the head units and with a positioning accuracy of not more than ½ of the nozzle pitch in the projected nozzle row.

According to this mode, since the positioning accuracy of the intermediate units is less strict than the positioning accuracy of the head units with respect to the intermediate units, then installation (replacement) of individual intermediate units becomes easy to perform.

(Invention 5): The liquid ejection head as defined in any one of the inventions 1 to 4, wherein a relationship between the total number of nozzles $N_A$ in a joint section between the head units and the total number of nozzles $N_B$ in a joint section between the intermediate units satisfies: $2\times N_A\leq N_B$.

Desirably, the relationship between the total number of nozzles $N_A$ in the joint section between head modules and the total number of nozzles $N_B$ in the joint section between intermediate units satisfies the relationship $5\times N_A\leq N_B$.

(Invention 6): The liquid ejection head as defined in any one of the inventions 1 to 5, wherein the total number of nozzles $N_A$ in a joint section between the head units satisfies the relationship: $2\leq N_A\leq 10$.

In this mode, even if the ejection resolution of the liquid ejection head exceeds 600 dots per inch (where the nozzle pitch in the projected nozzle row is 42.4 micrometers), then it is possible to further reduce the number of redundant nozzles included in the joint sections between head units, while diminishing discontinuity of liquid ejection in the joint sections between head units.

(Invention 7): The liquid ejection head as defined in any one of the inventions 1 to 6, wherein the total number of nozzles $N_B$ included in a joint section between the intermediate units satisfies the relationship: $N_B\leq 50$.

In this mode, even if the ejection resolution of the liquid ejection head exceeds 600 dots per inch (if the nozzle pitch in the projected nozzle row is 42.4 micrometers), it is still possible to diminish discontinuity of liquid ejection in the joint sections between the intermediate units.

(Invention 8): The liquid ejection head as defined in any one of the inventions 1 to 7, wherein the head units provided in the intermediate units are bonded by adhesive or are formed in an integrated fashion with the intermediate units.

According to this mode, the head units can be fixed with high accuracy (with a positioning accuracy of approximately several micrometers).

(Invention 9): The liquid ejection head as defined in any one of the inventions 1 to 8, wherein the intermediate units are fixed by mechanical fixing members.

According to this mode, installation of each individual intermediate unit is easy to perform and the intermediate units can be replaced individually.

Concrete examples of fixing using a "mechanical fixing member" in this mode are screw fastening, spring fastening, fixing by insert fitting, fixing by abutment, push fitting using elastic components, and so on.

(Invention 10): A liquid ejection apparatus, comprising a liquid ejection head including: a head unit provided with a plurality of nozzles which eject liquid; and an intermediate unit provided with a fixing section to which a plurality of the head units are fixed, wherein the intermediate unit is installed in such a manner that intermediate units can be replaced independently, the intermediate unit has a structure in which portions of the nozzles of two head units that are mutually adjacent in a second direction perpendicular to a first direction are mutually overlapped in the first direction, and the positions of two head units that are mutually adjacent in the second direction are not overlapped in the second direction; and in a joint section where portions of nozzles of head units that are mutually adjacent in the second direction are overlapped, a relationship between a total number of nozzles $N_A$ included in a joint section between the head units belonging to a same intermediate unit and a total number of nozzles $N_B$ included in a joint section between the intermediate units satisfies: $N_A<N_B$.

Desirably, the present invention includes the liquid ejection head described in any one of the inventions 2 to 9.

(Invention 11): The liquid ejection apparatus as defined in the invention 10, further comprising an ejection control unit which controls ejection by the liquid ejection head in such a manner that when liquid is ejected from nozzles included in the joint section, thinned ejection is performed by not using portions of the nozzles included in the joint section, in the first direction.

In this mode, desirably, thinned ejection is carried out in the second direction.

(Invention 12): The liquid ejection apparatus as defined in the invention 11, wherein the ejection control unit controls ejection by the liquid ejection head in such a manner that, when liquid is ejected from nozzles included in a joint section between intermediate units, an ejection duty of one of the intermediate units is reduced in stepwise fashion in the second direction while an ejection duty of the other one of the intermediate units is increased in stepwise fashion in the second direction.

In this mode, desirably, the ejection duty is changed in two to five steps.

(Invention 13): The liquid ejection apparatus as defined in any one of the inventions 10 to 12, further comprising a movement device for relatively moving the liquid ejection head and a medium which receives liquid ejected from the liquid ejection head, wherein the liquid ejection head has a structure in which nozzles are arranged through a length in a direction perpendicular to a movement direction of the movement device in a region of the medium where liquid is ejected; and the first direction is a direction perpendicular to the movement direction of the movement device and the second direction is the movement direction of the movement device.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a head unit provided with a plurality of nozzles which eject liquid; and an intermediate unit provided with a fixing section to which a plurality of the head units are fixed, wherein the intermediate unit is installed in such a manner that intermediate units can be replaced independently, the intermediate unit has a structure in which portions of the nozzles of two head units that are mutually adjacent in a second direction perpendicular to a first direction are mutually overlapped in the first direction, and positions of two head units that are mutually adjacent in the second direction are not overlapped in the second direction, and in a joint section where portions of nozzles of head units that are mutually adjacent in the second direction are overlapped, a relationship between a total number of nozzles $N_A$ included in a joint section between the head units belonging to a same intermediate unit and a total number of nozzles $N_B$ included in a joint section between the intermediate units satisfies:

$$N_A<N_B.$$

2. The liquid ejection head as defined in claim 1, wherein the head units have a uniform nozzle pitch in a projected nozzle row obtained by projecting all of the nozzles to an alignment in the first direction.

3. The liquid ejection head as defined in claim 2, wherein the head units are fixed to the intermediate unit with a positioning accuracy of not more than ¼ of the nozzle pitch in the projected nozzle row.

4. The liquid ejection head as defined in claim 3, wherein the plurality of intermediate units are fixed with a positioning accuracy lower than the positioning accuracy of fixing of the head units and with a positioning accuracy of not more than ½ of the nozzle pitch in the projected nozzle row.

5. The liquid ejection head as defined in claim 1, wherein a relationship between the total number of nozzles $N_A$ in a joint section between the head units and the total number of nozzles $N_B$ in a joint section between the intermediate units satisfies:

$$2\times N_A\leq N_B.$$

6. The liquid ejection head as defined in claim 1, wherein the total number of nozzles $N_A$ in a joint section between the head units satisfies the relationship:

$$2\leq N_A\leq 10.$$

7. The liquid ejection head as defined in claim 1, wherein the total number of nozzles $N_B$ included in a joint section between the intermediate units satisfies the relationship:

$$N_B\leq 50.$$

8. The liquid ejection head as defined in claim 1, wherein the head units provided in the intermediate units are bonded by adhesive or are formed in an integrated fashion with the intermediate units.

9. The liquid ejection head as defined in claim 1, wherein the intermediate units are fixed by mechanical fixing members.

10. A liquid ejection apparatus, comprising a liquid ejection head including:

a head unit provided with a plurality of nozzles which eject liquid; and an intermediate unit provided with a fixing section to which a plurality of the head units are fixed, wherein the intermediate unit is installed in such a manner that intermediate units can be replaced independently, the intermediate unit has a structure in which portions of the nozzles of two head units that are mutually adjacent in a second direction perpendicular to a first direction are mutually overlapped in the first direction, and the positions of two head units that are mutually adjacent in the second direction are not overlapped in the second direction; and in a joint section where portions of nozzles of head units that are mutually adjacent in the second direction are overlapped, a relationship between a total number of nozzles $N_A$ included in a joint section between the head units belonging to a same intermediate unit and a total number of nozzles $N_B$ included in a joint section between the intermediate units satisfies:

$$N_A<N_B.$$

11. The liquid ejection apparatus as defined in claim 10, further comprising an ejection control unit which controls ejection by the liquid ejection head in such a manner that when liquid is ejected from nozzles included in the joint section, thinned ejection is performed by not using portions of the nozzles included in the joint section, in the first direction.

12. The liquid ejection apparatus as defined in claim 11, wherein the ejection control unit controls ejection by the liquid ejection head in such a manner that, when liquid is ejected from nozzles included in a joint section between intermediate units, an ejection duty of one of the intermediate units is reduced in stepwise fashion in the second direction while an ejection duty of the other one of the intermediate units is increased in stepwise fashion in the second direction.

13. The liquid ejection apparatus as defined in claim 10, further comprising a movement device for relatively moving the liquid ejection head and a medium which receives liquid ejected from the liquid ejection head, wherein the liquid ejection head has a structure in which nozzles are arranged through a length in a direction perpendicular to a movement direction of the movement device in a region of the medium where liquid is ejected; and the first direction is a direction perpendicular to the movement direction of the movement device and the second direction is the movement direction of the movement device.

* * * * *